US008498565B2

(12) United States Patent
Kabata et al.

(10) Patent No.: US 8,498,565 B2
(45) Date of Patent: Jul. 30, 2013

(54) CLEANING BLADE, AND IMAGE FORMING APPARATUS AND PROCESS CARTRIDGE USING THE SAME

(75) Inventors: Toshiyuki Kabata, Kanagawa (JP); Momoko Shionoiri, Kanagawa (JP); Masanobu Gondoh, Kanagawa (JP); Yohta Sakon, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 350 days.

(21) Appl. No.: 12/957,850

(22) Filed: Dec. 1, 2010

(65) Prior Publication Data

US 2011/0135361 A1 Jun. 9, 2011

(30) Foreign Application Priority Data

| | | |
|---|---|---|
| Dec. 4, 2009 | (JP) | 2009-276475 |
| Aug. 26, 2010 | (JP) | 2010-189795 |
| Sep. 9, 2010 | (JP) | 2010-202251 |
| Nov. 15, 2010 | (JP) | 2010-254567 |

(51) Int. Cl.
*G03G 21/00* (2006.01)

(52) U.S. Cl.
USPC ..... 399/350

(58) Field of Classification Search
USPC ..... 399/350, 351
See application file for complete search history.

(56) References Cited

U.S. PATENT DOCUMENTS

| | | | | |
|---|---|---|---|---|
| 6,580,897 | B2 * | 6/2003 | Sato et al. | 399/350 |
| 7,693,476 | B2 | 4/2010 | Hatakeyama et al. | |
| 7,734,242 | B2 | 6/2010 | Hatakeyama et al. | |
| 7,738,829 | B2 | 6/2010 | Hatakeyama et al. | |
| 7,826,787 | B2 | 11/2010 | Hatakeyama et al. | |
| 2009/0003853 | A1 | 1/2009 | Hatakeyama et al. | |
| 2009/0028618 | A1 | 1/2009 | Kabata et al. | |
| 2009/0232541 | A1 | 9/2009 | Hatakeyama et al. | |
| 2009/0311017 | A1 * | 12/2009 | Ohmori et al. | 399/350 |

FOREIGN PATENT DOCUMENTS

| | | | |
|---|---|---|---|
| JP | 59214069 | A * | 12/1984 |
| JP | 05165386 | A * | 7/1993 |
| JP | 09127846 | A * | 5/1997 |
| JP | 2000-66555 | | 3/2000 |
| JP | 3602898 | | 10/2004 |
| JP | 2005-107376 | | 4/2005 |

* cited by examiner

*Primary Examiner* — Susan Lee
(74) *Attorney, Agent, or Firm* — Oblon, Spivak, McClelland, Maier & Neustadt, L.L.P.

(57) ABSTRACT

A cleaning blade for use in an image forming apparatus including a holder, and an elastic blade attached to the holder and in contact with an image bearing member, the elastic blade being impregnated with an acrylate polymer from at least one surface to a depth of from 5 to 100 μm.

17 Claims, 6 Drawing Sheets

CLEANING BLADE, AND IMAGE FORMING APPARATUS AND PROCESS CARTRIDGE USING THE SAME

BACKGROUND OF THE INVENTION

1. Field of the Invention

The present invention relates to a cleaning blade, and an image forming apparatus and a process cartridge using the cleaning blade.

2. Description of the Related Art

In image forming apparatuses using electrophotography, images are formed through processes of charging, irradiation, development, transfer etc. applied to an image bearing member.

Ordinarily, corona products produced in the charging process that remain on the surface of the image bearing member, and toner or its components remaining on the surface of the image bearing member after the transfer process, are removed by a cleaning process.

In terms of improving the reliability of the image forming apparatus, an image bearing member formed of an inorganic material such as amorphous silicon, or a highly durable image bearing member that has a surface layer in which an acrylate-based material or inorganic particulates are dispersed, are now widely used. These image bearing members, such as photoreceptors, have excellent abrasion resistance against a cleaning blade. Therefore, such image bearing members have by far a longer working life than once typically used image bearing members, resulting in significantly less frequent maintenance and replacement, which is greatly preferable in terms of impact on the environment and cost savings.

However, although successful in prolonging the working life of the image bearing member, the frequency of replacement thereof remains unchanged unless the working life of the cleaning blade is also prolonged. In addition, in the type of image forming apparatus of late, use of a process cartridge in which members such as the image bearing member and the cleaning blade are combined into a single integrated unit has become popular because it facilitates maintenance of the image forming apparatus. Therefore, the working life of the cleaning blade becomes a bottleneck, in that it necessitates replacement of the entire of the process cartridge even though the image bearing member is not completely worn out.

The cleaning blade is typically formed of an elastic body such as polyurethane rubber with a reed-like shape and removes toner remaining on the image bearing member by pressing the ridge line of the front end of the cleaning blade against the circumference surface of the image bearing member while supporting the base end of the cleaning blade with a supporting member.

In addition, an image forming apparatus using a toner having a form significantly close to a sphere with a small particle diameter manufactured by a polymerization method, etc. has been introduced into the market to meet recent demand for improvement of image quality. This polymerized toner has excellent transfer efficiency in comparison with typical toner and is capable of satisfying demand for improved image quality. However, the polymerized toner is difficult to sufficiently remove from the surface of the image bearing member with the cleaning blade, thereby causing a problem with regard to the cleaning performance. This difficulty of removal occurs because the polymerized toner particles have a near-spherical form and are of such a small size that they slip through the small gap between the cleaning blade and the image bearing member.

One way to prevent such slip-through of the toner is to increase the contact pressure between the image bearing member and the cleaning blade. However, as illustrated in FIG. 8A, if the contact pressure of the cleaning blade is increased, the friction between an image bearing member 23 and a cleaning blade 262 increases so that the cleaning blade 262 is drawn in the moving direction of the image bearing member 23, resulting in turning inward or outward of a front edge portion 262*c* of the cleaning blade 262.

If cleaning continues with the front edge portion 262*c* turned inward or outward, the cleaning blade is easily abraded, which creates a locally abraded portion several μm from the front edge portion 262*c* of a front end surface 262*a* of the cleaning blade 262 as illustrated in FIG. 8B. If cleaning still continues in this state, the locally abraded portion increases, and finally leads to chipping of the front edge portion 262*c* as illustrated in FIG. 8C. Once part of the front edge portion 262*c* has chipped off, the cleaning blade no longer removes the toner sufficiently, resulting in poor cleaning performance, meaning the end of the working life of the cleaning blade. A bottom surface 262*b* of the cleaning 262 is perpendicular to the front end surface 262*a*.

To prolong the working life of the cleaning blade, for example, Japanese patent application publication no. 2005-107376 (hereinafter referred to as JP-2005-107376-A) describes a polyurethane elastomer cleaning blade having a layer formed of isocyanate with a thickness of 0.1 mm at the portion of contact with the image bearing member. However, although suitable for an image bearing member having a smooth surface made of a material such as amorphous silicon, this cleaning blade chips off at an early stage and causes poor cleaning performance in most cases when it cleans a roughened surface of an image bearing member such as an organic photoconductor using inorganic particulates for the surface layer to improve the cleaning property and/or the abrasion resistance.

JP-2000-66555-A describes an image forming apparatus that has a decreased friction force between the image bearing member and the cleaning blade, accomplished by providing a low-friction layer to the cleaning blade. This cleaning blade demonstrates extremely good cleaning performance at an initial stage before a great number of images are formed.

However, as image formation processes are repeated, the low-friction material on the uppermost surface of the low-friction layer drops off, resulting in an increase in the abrasion force between the image bearing member and the cleaning blade, which leads to localized chipping of the cleaning blade. Consequently, poor cleaning is unavoidable.

Japanese patent no. 3602898 (hereinafter referred to as JP-3602898-B) describes a polyurethane elastomer cleaning blade. At least the contact portion of the cleaning blade with an image bearing member is manufactured by impregnation of a urethane acrylate monomer followed by irradiation of UV light for curing. This cleaning blade is suitably used at an initial stage before a number of images are formed. However, as image formation is repeated, in many cases the top of the cleaning blade contacting the image bearing member chips off, resulting in poor cleaning performance.

The hardness of the urethane acrylate monomer described in JP 3602898 cannot be measured once it infiltrates the polyurethane elastomer. Therefore, the urethane acrylate monomer is applied to a glass plate and irradiated with UV light to form a cured layer. The cured layer is confirmed to have a sufficient hardness. However, the hardness of the polyurethane elastomer which is impregnated with the urethane acrylate monomer followed by irradiation of UV light is unexpectedly insufficient and is almost the same as or softer than the hardness of untreated polyurethane elastomer.

The present inventors have carefully investigated the poor performance of the cleaning blade described in JP 3602898 and found that most of the urethane acrylate monomer that has infiltrated the polyurethane elastomer is not polymerized but forms an oligomer having a small molecular weight.

The urethane acrylate monomer is polymerized in the processes of producing radicals by absorption of UV light by a polymerization initiator and opening up the C—C double bond of the urethane acrylate monomer in a chain reaction.

The life of a radical is typically only several tens of nanoseconds, and most of the radicals are deactivated by oxygen, etc. If a monomer is present around the radical produced by irradiation of sufficient amount of UV light, polymerization smoothly proceeds. However, in the case of the urethane acrylate monomer that has infiltrated the cleaning blade, since the UV light penetrates the urethane acrylate monomer via the polyurethane elastomer, the amount of radicals produced is extremely small.

In addition, the concentration of the urethane acrylate monomer is thin. Therefore, most of the urethane acrylate monomers are not polymerized and it is found that the polymerized area reaches a depth of only 3 to 4 μm at most.

Since non-reacted urethane acrylate monomers and oligomers in the polyurethane elastomer weaken the polyurethane elastomer, the cleaning blade easily chips off at even a slight abrasion, which leads to poor cleaning performance.

SUMMARY OF THE INVENTION

For these reasons, the present inventors recognize that a need exists for a cleaning blade having good durability and superior cleaning capabilities, by which an image forming apparatus and a process cartridge that can produce quality images for an extended period of time are provided.

Accordingly, an object of the present invention is to provide a cleaning blade having good durability and excellent cleaning capabilities. This and other objects of the present invention as hereinafter described will become more readily apparent and can be attained, either individually or in combination thereof, by a cleaning blade for use in an image forming apparatus having a holder, and an elastic blade attached to the holder and in contact with an image bearing member, the elastic blade being impregnated with an acrylate polymer from at least one surface to a depth of from 5 to 100 μm.

It is preferred that, in the cleaning blade described above, the at least one surface is a contact surface which is in contact with the image bearing member and is disposed parallel to a longitudinal direction of the elastic blade, and a position having a ratio of A/B to A0/B0 of 1.1 is within a depth range of from 5 to 100 μm from the contact surface, where A represents a peak area value for 1,700 $cm^{-1}$ obtained by an IR method for a segment of the elastic blade, B represents a peak area value for 1,597 $cm^{-1}$ obtained by a micro infrared (IR) method according to transmission for the segment of the elastic blade, A0 represents a peak area value for 1,700 $cm^{-1}$ obtained by a micro infrared (IR) method according to transmission for a segment of another elastic blade which is different from the elastic blade in that no acrylate polymer is applied, and B0 represents a peak area value for 1,597 $cm^{-1}$ obtained by a micro infrared (IR) method according to transmission for the segment of the another elastic blade which is different from the elastic blade in that no acrylate polymer is applied.

As another of the present invention, an image forming apparatus is provided which includes a charger that charges the surface of the image bearing member, an irradiator that irradiates the surface of the image bearing member to form a latent image bearing member thereon, a development device that develops the latent image bearing member with toner to obtain a toner image, a transfer device that transfers the toner image to a recording medium; and a cleaning device that removes the toner remaining on the surface of the image bearing member after transfer, the cleaning blade including a holder and an elastic blade attached to the holder and in contact with the image bearing member, the elastic blade being impregnated with an acrylate polymer from at least one surface to a depth of from 5 to 100 μm.

As another of the present invention, a process cartridge is provided which includes an image bearing member that bears a latent electrostatic image on a surface thereof and a cleaning device that removes the toner remaining on the surface of the image bearing member after transfer, the cleaning blade comprising a holder and an elastic blade attached to the holder and in contact with the image bearing member, the elastic blade being impregnated with an acrylate polymer from at least one surface to a depth of from 5 to 100 μm.

These and other objects, features and advantages of the present invention will become apparent upon consideration of the following description of the preferred embodiments of the present invention (taken in conjunction with the accompanying drawings.

These and other objects, features and advantages of the present invention will become apparent upon consideration of the following description of the preferred embodiments of the present invention (taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1:
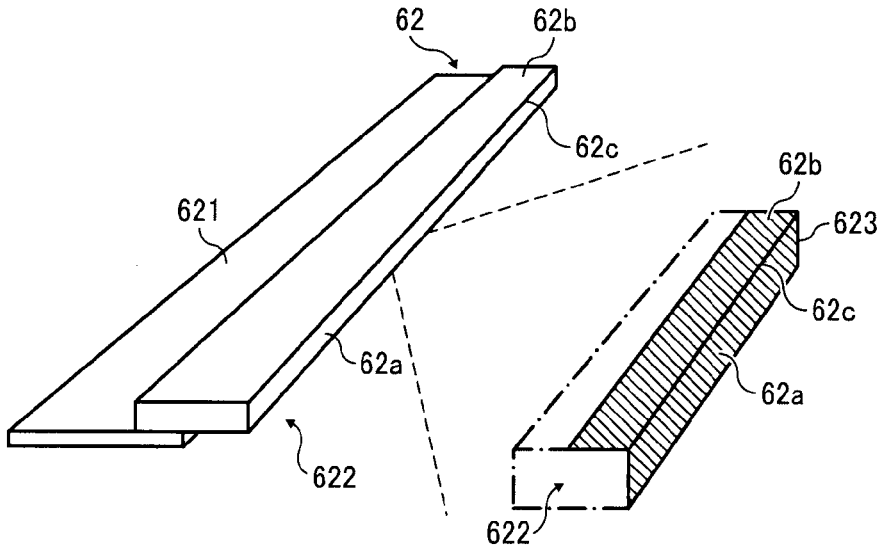
FIG. 1 is a schematic perspective view illustrating an embodiment of the cleaning blade of the present disclosure for use in an image forming apparatus.

Herein, a cleaning blade for use in an image forming apparatus having a holder, and an elastic blade attached to the holder and in contact with an image bearing member, the elastic blade being impregnated with an acrylate polymer from at least one surface to a depth of from 5 to 100 μm is described.

According to this structure, a cleaning blade is provided that has a greatly improved durability and an excellent cleaning property for an extended period of time.

It is preferable that, in the cleaning blade described above, the at least one surface is a contact surface which is in contact with the image bearing member and in parallel to the longitudinal direction of the elastic blade, and a position having a ratio of A/B to A0/B0 of 1.1 is within a depth range of from 5 to 100 μm from the contact surface, where A represents a peak area value for 1,700 $cm^{-1}$ obtained by an IR method for a segment of the elastic blade, B represents a peak area value for 1,597 $cm^{-1}$ obtained by a micro infrared (IR) method according to transmission for the segment of the elastic blade, A0 represents a peak area value for 1,700 $cm^{-1}$ obtained by a micro infrared (IR) method according to transmission for a segment of another elastic blade which is different from the elastic blade in that no acrylate polymer is applied, and B0 represents a peak area value for 1,597 $cm^{-1}$ obtained by a micro infrared (IR) method according to transmission for the segment of the another elastic blade which is different from the elastic blade in that no acrylate polymer is applied.

According to this structure, the extent to which the contact surface of the cleaning blade is impregnated with acrylate polymer is exactly obtained and suitably controlled to provide a cleaning blade capable of providing good cleaning performance for an extended period of time.

It is still further preferable that, in the cleaning blade described above, the at least one surface is a cut surface which is perpendicular to the longitudinal direction of the elastic blade, and a position having a ratio of A/B to A0/B0 of 1.1 is within a depth range of from 5 to 100 μm from the cut surface, where A represents a peak area value for 1,700 $cm^{-1}$ obtained by a micro infrared (IR) method according to transmission for a segment of the elastic blade, B represents a peak area value for 1,597 $cm^{-1}$ obtained by a micro infrared (IR) method according to transmission for the segment of the elastic blade, A0 represents a peak area value for 1,700 $cm^{-1}$ obtained by a micro infrared (IR) method according to transmission for a segment of another elastic blade which is different from the elastic blade in that no acrylate polymer is applied, and B0 represents a peak area value for 1,597 $cm^{-1}$ obtained by a micro infrared (IR) method according to transmission for the segment of the another elastic blade which is different from the elastic blade in that no acrylate polymer is applied.

According to this structure, the level of the impregnation of the acrylate polymer into cut surface of the cleaning blade is exactly obtained and suitably controlled to provide a cleaning blade capable of providing good cleaning performance for an extended period of time.

It is still further preferable that, in the cleaning blade described above, one of the at least two surfaces is a contact surface which is in contact with the image bearing member and in parallel to a longitudinal direction of the elastic blade, and another of the at least two surface is a cut surface which is perpendicular to a longitudinal direction of the elastic blade, and wherein a ratio of X/Y is from 0.1 to 10, where X represents a distance between the contact surface and a position having a ratio of A/B to A0/B0 of 1.1, where A represents a peak area value for 1,700 $cm^{-1}$ obtained by the micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied, and Y represents a distance between the cut surface and a position having a ratio of A/B to A0/B0 of 1.1, where A represents a peak area value for 1,700 $cm^{-1}$ obtained by the micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, the level of the impregnation of the acrylate polymer into cut surface and the contact surface of the cleaning blade is exactly obtained and suitably controlled to provide a cleaning blade capable of providing good cleaning performance for an extended period of time.

It is still further preferable that, in the cleaning blade described above, a surface layer containing acrylate polymer with a thickness of from 0.1 to 3 μm is laminated on the elastic blade.

According to this structure, the rigidity of the contact surface of the cut surface of the cleaning blade is improved so that the durability of the cleaning blade is highly improved and thus the obtained cleaning blade maintains good cleaning performance for an extended period of time.

It is still further preferable that, in the cleaning blade described above, the elastic blade is manufactured by a process of soaking the elastic blade in a polymerizable acrylate monomer, followed by irradiating the elastic blade with an energy beam to polymerize the polymerizable acrylate monomer.

According to this structure, the acrylate monomer is polymerized in a short time to obtain a cleaning blade that has good durability and is capable of providing good cleaning performance for an extended period of time.

It is still further preferable that, in the cleaning blade described above, the radiation of an energy beam is conducted in an environment in which oxygen density is 2% or less.

According to this structure, since polymerization of the acrylate inside the cleaning blade is completely conducted, the obtained cleaning blade has a greatly improved durability and is capable of providing good cleaning performance for an extended period of time.

In the present disclosure, an image forming apparatus is described that includes an image bearing member that bears a latent electrostatic image on the surface thereof, a charger that charges the surface of the image bearing member, an irradiator that irradiates the surface of the image bearing member to form a latent image bearing member thereon, a development device that develops the latent image bearing member with toner to obtain a toner image, a transfer device that transfers the toner image to a recording medium, and a cleaning device that removes the toner remaining on the surface of the image bearing member after transfer, the cleaning blade having a holder and an elastic blade attached to the holder and in contact with the image bearing member, the elastic blade being impregnated with an acrylate polymer from at least one surface to a depth of from 5 to 100 μm.

According to this structure, an image forming apparatus is provided that has a cleaning blade having greatly improved durability and excellent cleaning capabilities sustained for an extended period of time.

It is preferable that, in the image forming apparatus described above, the at least one surface is a contact surface which is in contact with the image bearing member and disposed parallel to the longitudinal direction of the elastic blade, and a position having a ratio of A/B to A0/B0 of 1.1 is within a depth range of from 5 to 100 μm from the contact surface, where A represents a peak area value for 1,700 $cm^{-1}$ obtained by an IR method for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained image forming apparatus, the extent to which the contact surface of the cleaning blade is impregnated with acrylate polymer is exactly obtained and suitably controlled to provide a cleaning blade capable of providing good cleaning performance for an extended period of time.

It is still further preferable that, in the image forming apparatus described above, the at least one surface is a cut surface which is perpendicular to the longitudinal direction of the elastic blade, and a position having a ratio of A/B to A0/B0 of 1.1 is within a depth range of from 5 to 100 μm from the cut surface, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained image forming apparatus, the level of the impregnation of the acrylate polymer into cut surface of the cleaning blade is exactly obtained and suitably controlled to provide a cleaning blade capable of providing good cleaning performance for an extended period of time.

It is still further preferable that, in the image forming apparatus described above, one of the at least one surface is a contact surface which is in contact with the image bearing member and in parallel to the longitudinal direction of the elastic blade, and another of the at least one surface is a cut surface which is perpendicular to the longitudinal direction of the elastic blade, and wherein a ratio of X/Y is from 0.1 to 10, where X represents a distance between the contact surface and a position having a ratio of A/B to A0/B0 of 1.1, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents peak area value for 1,700 $cm^{-1}$ obtained by the IR method for a segment of another elastic blade which is different from the elastic blade in that no acrylate polymer is applied, and B0 represents peak area value for 1,597 $cm^{-1}$ obtained by the micro infrared (IR) method according to transmission for the segment of the another elastic blade which is different from the elastic blade in that no acrylate polymer is applied, and Y represents a distance between the cut surface and a position having a ratio of A/B to A0/B0 of 1.1, where A represents a peak area value for 1,700 $cm^{-1}$ obtained by the micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained image forming apparatus, the level of the impregnation of the acrylate polymer into cut surface and the contact surface of the cleaning blade is exactly obtained and suitably controlled to provide a cleaning blade capable of providing good cleaning performance for an extended period of time.

It is still further preferable that, in the image forming apparatus described above, a surface layer containing the acrylate polymer with a thickness of from 0.1 to 3 μm is laminated on the elastic blade.

According to this structure, in the obtained image forming apparatus, the rigidity of the contact surface of the cut surface of the cleaning blade is improved so that the durability of the cleaning blade is highly improved and thus the obtained cleaning blade maintains good cleaning performance for an extended period of time.

It is still further preferable that, in the image forming apparatus described above, the elastic blade is manufactured by a process of soaking the elastic blade in a polymerizable acrylate monomer, followed by irradiation of an energy beam to the elastic blade to polymerize the polymerizable acrylate monomer.

According to this structure, in the obtained image forming apparatus, the acrylate monomer is polymerized in a short time to obtain a cleaning blade that has a high durability and is capable of providing good cleaning performance for an extended period of time.

It is still further preferable that, in the image forming apparatus described above, the irradiation of an energy beam is conducted in an environment in which an oxygen density is 2% or less.

According to this structure, in the obtained image forming apparatus, since polymerization of the acrylate inside the cleaning blade is completely conducted, the obtained cleaning blade has a greatly improved durability and is capable of providing good cleaning performance for an extended period of time.

In the present disclosure, a process cartridge is described that includes an image bearing member that bears a latent electrostatic image on a surface thereof; and a cleaning device that removes the toner remaining on the surface of the image bearing member after transfer, the cleaning blade comprising a holder and an elastic blade attached to the holder and in contact with the image bearing member, the elastic blade being impregnated with an acrylate polymer from at least one surface to a depth of from 5 to 100 μm.

According to this structure, a process cartridge image forming is provided that has an cleaning blade having a greatly improved durability and an excellent cleaning property for an extended period of time.

It is preferable that, in the process cartridge described above, the at least one surface is a contact surface which is in contact with the image bearing member and in parallel to the longitudinal direction of the elastic blade, and a position having a ratio of A/B to A0/B0 of 1.1 is within a depth range of from 5 to 100 μm from the contact surface, where A represents a peak area value for 1,700 $cm^{-1}$ obtained by an IR method for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained process cartridge, the extent to which the contact surface of the cleaning blade is impregnated with acrylate polymer is exactly obtained and suitably controlled to provide a cleaning blade capable of providing good cleaning performance for an extended period of time.

It is preferable that, in the process cartridge described above, the at least one surface is a cut surface which is perpendicular to the longitudinal direction of the elastic blade, and a position having a ratio of A/B to A0/B0 of 1.1 is within a depth range of from 5 to 100 μm from the cut surface, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained process cartridge, the level of the impregnation of the acrylate polymer into cut surface of the cleaning blade is exactly obtained and suitably controlled to provide a cleaning blade capable of providing good cleaning performance for an extended period of time.

It is preferable that, in the process cartridge described above, one of the at least one surface is a contact surface which is in contact with the image bearing member and in parallel to the longitudinal direction of the elastic blade, and another of the at least one surface is a cut surface which is perpendicular to the longitudinal direction of the elastic blade, and wherein a ratio of X/Y is from 0.1 to 10, where X represents a distance between the contact surface and a position having a ratio of A/B to A0/B0 of 1.1, where A represents a peak area value for 1,700 $cm^{-1}$ obtained by an micro infrared (IR) method according to transmission for a segment of the elastic blade, B represents a peak area value for 1,597 $cm^{-1}$ obtained by the micro infrared (IR) method according to transmission for the segment of the elastic blade, A0 represents peak area value for 1,700 $cm^{-1}$ obtained by the micro infrared (IR) method according to transmission for a segment of another elastic blade which is different from the elastic blade in that no acrylate polymer is applied, and B0 represents peak area value for 1,597 $cm^{-1}$ obtained by the micro infrared (IR) method according to transmission for the segment of the another elastic blade which is different from the elastic blade in that no acrylate polymer is applied, and Y represents a distance between the cut surface and a position having a ratio of A/B to A0/B0 of 1.1, where A represents a peak area value for 1,700 $cm^{-1}$ obtained by the micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of another elastic blade which is different from the elastic blade in that no acrylate polymer is applied, and B0 represents a peak area value for 1,597 $cm^{-1}$ obtained by the micro infrared (IR) method according to transmission for the segment of the another elastic blade which is different from the elastic blade in that no acrylate polymer is applied.

According to this structure, in the obtained process cartridge, the level of the impregnation of the acrylate polymer into cut surface and the contact surface of the cleaning blade is exactly obtained and suitably controlled to provide a cleaning blade capable of providing good cleaning performance for an extended period of time.

It is preferable that, in the process cartridge described above, a surface layer containing the acrylate polymer with a thickness of from 0.1 to 3 μm is laminated on the elastic blade.

According to this structure, in the obtained process cartridge, the rigidity of the contact surface of the cut surface of the cleaning blade is improved so that the durability of the cleaning blade is highly improved and thus the obtained cleaning blade maintains good cleaning performance for an extended period of time.

It is preferable that, in the process cartridge described above, the elastic blade is manufactured by a process of soaking the elastic blade in a polymerizable acrylate monomer, followed by irradiation of an energy beam to the elastic blade to polymerize the polymerizable acrylate monomer.

According to this structure, in the obtained process cartridge, the acrylate monomer is polymerized in a short time to obtain a cleaning blade that has a high durability and is capable of providing good cleaning performance for an extended period of time.

The image forming apparatus of the present disclosure includes a cleaning device that removes toner remaining on the image bearing member after the toner image formed on the image bearing member is transferred. The cleaning blade is impregnated with an acrylate polymer from its surface to a depth of from 5 to 100 μm.

The image bearing member in the present disclosure represents a photoreceptor, or an intermediate transfer body.

The present inventors have found that the impregnation depth of the acrylate polymer into the cleaning blade can be exactly measured by a Fourier Transform Infrared Spectrometer and Infrared Microscope method (transmission method) and controlled to be within the range of from 5 to 100 μm.

In addition, the present inventors have made a further inventive study based on an idea that although polymerization of the acrylate urethane monomers is inhibited by oxygen, the acrylate monomers can be smoothly polymerized in a low oxygen density environment even when the irradiation amount of UV is small, and the density of acrylate monomer is low.

As a result of this inventive study, it is found that the cleaning blade can be impregnated with an acrylate monomer and the acrylate monomer can be polymerized in a low oxygen environment, particularly in which the oxygen density is 2% or less.

The thus obtained cleaning blade is found to have an excellent durability and cleaning property simultaneously.

The image forming apparatus of the present disclosure is described in detail.

Cleaning Blade

Figure 2:
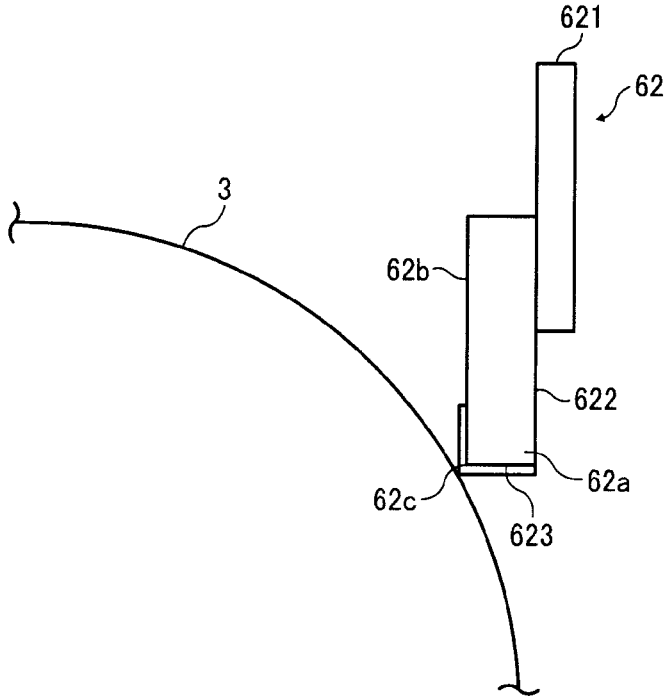
FIG. 2 is an enlarged cross-section of the cleaning blade illustrated in FIG. 1.

FIG. 1 is a perspective view of a cleaning blade 62, and FIG. 2 is an enlarged cross section of the cleaning blade 62.

The cleaning blade 62 is structured by a holder 621 having a reed shape formed of a rigid material such as metal or rigid plastic, and an elastic blade 622 having a reed shape. The elastic blade 622 includes a front end surface 62*a*, a bottom surface 62*b*, and a front edge 62*c* of the front end surface 62*a*, as illustrated in FIGS. 1 and 2.

Figure 5:
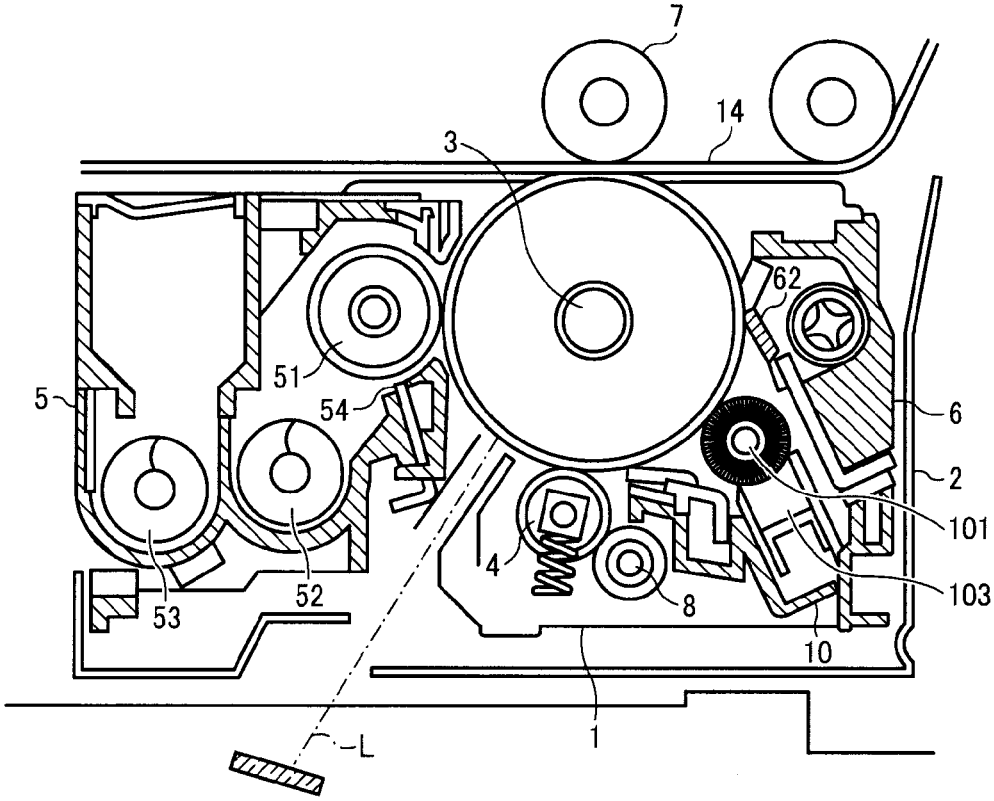
FIG. 5 is a schematic structure view illustrating the main portion of a printer as an embodiment of the image forming apparatus of the present disclosure.

The elastic blade 622 is fixed onto one end of the holder 621 with an additive, and the other end thereof is supported by a case of a cleaning device 6 (refer to FIG. 5).

Elastic Blade

The elastic blade 622 used as the main portion of the cleaning blade for use in the image forming apparatus of the present disclosure can be manufactured from a known composition according to a known processing method.

The elastic blade 622 preferably has a high impact resilience to follow the eccentricity of an image bearing member 3 and/or minute waving of the surface thereof. For example, urethane rubber (polyurethane elastomer) having a urethane group is suitable.

In addition, the elastic blade 622 preferably has a surface layer 623, which is described later.

Polyurethane elastomer is manufactured by preparing a prepolymer typically using polyethylene adipate esters, or polycaprolactone esters as the polyol, and 4,4'-diphenyl methane diisocyanate as the polyisocyanate group; adding a curing agent with an optional catalyst to start cross-linking of the prepolymers to form polymers having particular types; and further cross-linking in a furnace followed by cooling down and aging at room temperature.

Specific examples of the polyol having a large molecular weight include, but are not limited to, polyester polyol, i.e., a condensation of an alkylene glycol and a aliphatic dibasic acid such as polyester-based polyols such as polyester polyols of alkylene glycol and adipic acid such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone based polyols such as polycaprolactone ester polyols obtained by ring-opening polymerization of caprolactone; and polyether-based polyols such as poly (oxytetramethylene) glycol, and poly (oxypropylene) glycol.

Specific examples of the polyol having a low molecular weight include, but are not limited to, diols such as 1,4-butane diol, ethylene glycol, neopentyl glycol, hydroxynone-bis(2-hydroxyethyl)ether, 3,3'-dichloro-4,4'-diamino diphenyl methane, 4,4'-diaminodiphenyl methane, and tri- or higher alcohols such as 1,1,-trimethylol propane, glycerine, 1,2,6-hexane triol, 1,2,4-butane triol, tirmethylol ethane, 1,1,1-tris (hydroxyethyoxymethyl)propane, diglycerine, and pentaerythritol.

Specific examples of the curing catalysts include, but are not limited to, 2-methylimidazole, 1,2-dimethyl imidazole and particularly 1,2-dimethyl imidazole is preferably used.

Such a catalyst is used in an amount of from 0.01 to 0.5 parts by weight, and preferably from 0.05 to 0.3 parts by weight based on 100 parts of the main agent.

The surface of the cleaning blade is impregnated with acrylate polymer into a depth of from 5 to 100 μm, preferably from 8 to 80 μm, and more preferably from 10 to 60 μm.

When the cut surface or the contact surface described above of the cleaning blade is impregnated with the acrylate polymer, the cleaning blade has improved durability and cleaning property. However, impregnating both of the cut surface and the contact surface of the cleaning blade with the acrylate polymer is particularly preferable because the cleaning blade has furthermore improved durability and cleaning property.

When the depth of impregnation of the acrylate polymer into the cut surface and/or the contact surface is too shallow, the hardness on or around the contact surface and/or the cut surface tends to be not suitably improved. Therefore, turning inward or outward of the cleaning blade is not prevented, thereby degrading the durability and the cleaning property of such a cleaning blade in comparison even with a typical cleaning blade that is not impregnated with the acrylate polymer.

In addition, since it is difficult to impregnate the cleaning blade with the acrylate polymer uniformly with regard to the depth all over the longitudinal direction of the cleaning blade, the mechanical characteristics vary depending on the position on the cleaning blade so that the cleaning blade tends to start chipping off from where the mechanical strength is weak.

In addition, when the acrylate polymer is laminated to form a surface layer containing the acrylate polymer on the cut surface and the contact surface of the elastic blade and the depth of the impregnation of the acrylate polymer is too shallow, the formed acrylate polymer layer tends to crack or be peeled off, which leads to degradation of the durability of the cleaning blade.

To the contrary, when the depth of impregnation of the acrylate polymer into the cut surface and/or the contact surface is too deep, the cleaning blade tends to be hard so that the cleaning property deteriorates and the cleaning blade easily chips off.

When both of the cut surface and the contact surface are impregnated with the acrylate polymer, a ratio X/Y calculated from a distance X from the surface of the contact surface, the ratio of X/Y is from 0.1 to 10 and preferably from 0.1 to 9. X and Y represent as described above.

A ratio X/Y that is too small tends to degrade the cleaning property, which is not preferable. A ratio X/Y that is too great tends to degrade the durability of the cleaning blade and also the cleaning property, which is not preferable.

To laminate a surface layer containing the acrylate polymer on the cut surface and/or the contact surface of the elastic blade, the elastic blade is impregnated with the acrylate monomer according to a method such as spraying or dipping followed by irradiation of energy beams such as UV light and electron beams. Thus, the surface layer is laminated on the cut surface and/or the contact surface of the elastic blade and the elastic blade which is impregnated with the acrylate polymer is obtained.

The oxygen density around the cleaning blade at the irradiation of the energy beam is 2% or less, and preferably 1% or less.

When the oxygen density is too high, the acrylate monomers in the cleaning blade tend to be left non-reacted or forms oligomers. Therefore, the strength inside the cleaning blade deteriorates, which leads to chipping-off of the cleaning blade. This is not preferable.

Since the acrylate monomer and an optional solvent to lower the viscosity of the acrylate monomer normally contain dissolved oxygen, it is preferable to remove the dissolved oxygen by bubbling an inert gas such as nitrogen, helium, and argon and/or degassing with a reduced pressure.

Surface Layer

The surface layer 623 is preferably made of a resin. Specific examples of such resins include, but are not limited to, acrylic resins, lactone-modified urethane resins, acrylate, acrylic silicone resins, thermoplastic urethane resins, and phenol resins. These can be used alone or in combination.

In addition, the resin is not limited to, but is preferably the same material as the acrylate polymer with which the cleaning blade is impregnated to improve the adhesiveness of the surface layer and the durability of the cleaning blade.

The layer thickness of the contact surface of the surface layer 623 is preferably from 0.1 to 3 μm.

The surface layer 623 that is too thin means there is no difference between the cleaning blade and any typical cleaning blade so that the cleaning blade is easily turned inward or outward.

Furthermore, the excessively thin surface layer 623 that is made of the identical resin to the acrylate polymer with which the surface layer 623 is impregnated is technically difficult to manufacture.

The surface layer 623 that is too thick tends to make the cleaning blade rigid. Therefore, the cleaning blade is easily chipped-off, resulting in deterioration of the abrasion resistance.

Fourier Transform Infrared Spectrometer and Infrared Microscope Method (Transmission Method)

Next, the Fourier Transform Infrared Spectrometer and Infrared Microscope method (transmission method) is described that is used to measure the depth (level) of the impregnation of the acrylate polymer from the surface of the cleaning blade of the present disclosure.

A segment of the cleaning blade is measured by the Fourier Transform Infrared Spectrometer and Infrared Microscope method (transmission method) for the cleaning blade of the present disclosure.

The segment of the cleaning blade is manufactured by CRYO MICROTOME and is placed on a silicon wafer for measurement.

Manufacturing of Segment

The device of CRYO MICROTOME for use in the present disclosure is EM FCS (manufactured by Leica Corporation).

A sample is cooled down to −100° C. by liquid nitrogen and severed.

The sever direction by CRYO MICROTOME is along the direction perpendicular to the cut surface and the contact surface.

The portion to be severed is 5 to 10 mm away from the top of the contact portion along the contact surface and the cut surface.

The segment is stably manufactured by CRYO MICROTOME at that portion.

The thickness of the segment is desirably from 300 to 500 nm.

When the segment is too thin, the sensitivity of the measuring data tends to be low so that the impregnation depth is not correctly measured.

In addition, the segment can be cut in the middle.

When the segment is too thick, the light does not easily transmit the segment so that the measuring data are not sufficiently obtained. In addition, the segment tends to curl up, thereby making retrieval of the segment difficult.

Peak Area Value Measuring

The segment prepared by CRYO MICROTOME is placed on a silicon wafer and measured according to the Fourier Transform Infrared Spectrometer and Infrared Microscope method (transmission method).

The IR device for use in the present disclosure is FT/IR-6100 and the infra-red microscope is IR T-5000 (manufactured by JASCO Corporation).

Figure 9:
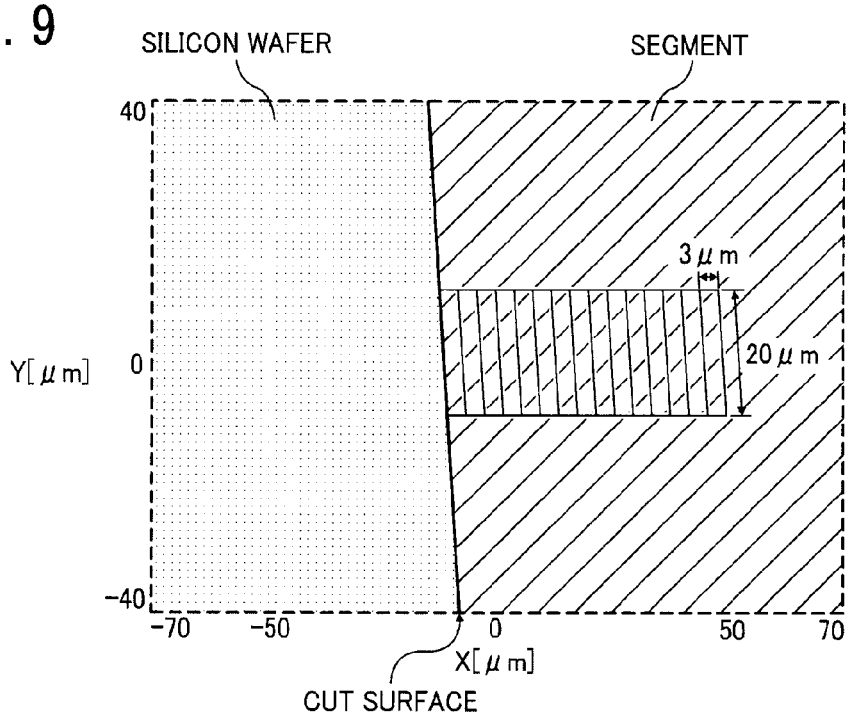
FIG. 9 is a diagram illustrating a segment on silicon wafer by an infra-red microscope.

An example of the state of the segment observed by the infra-red microscope is illustrated in FIG. 9.

The segment is observed on the right half of FIG. 9 and the silicon wafer is on the left half. The boundary is the surface of the cut surface.

The aperture size is a square of 2×20 μm (in the direction perpendicular to the contact surface×the contact surface direction). The segment on the silicon wafer is continuously measured by shifting the device by 3 μm perpendicularly from the contact surface of the segment and the surface of the cut surface.

Figure 3:
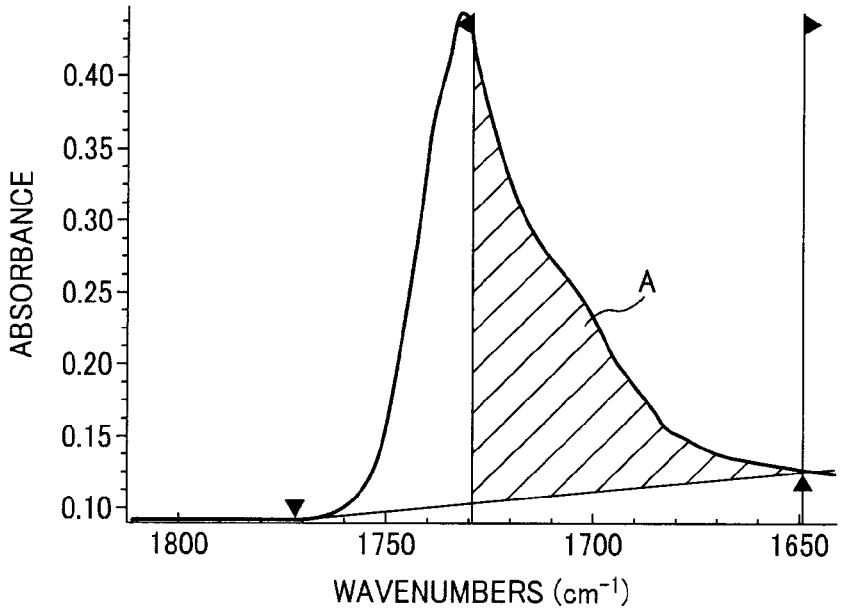
FIG. 3 is a graph illustrating a peak area value A measured based on IR spectrum.
Figure 4:
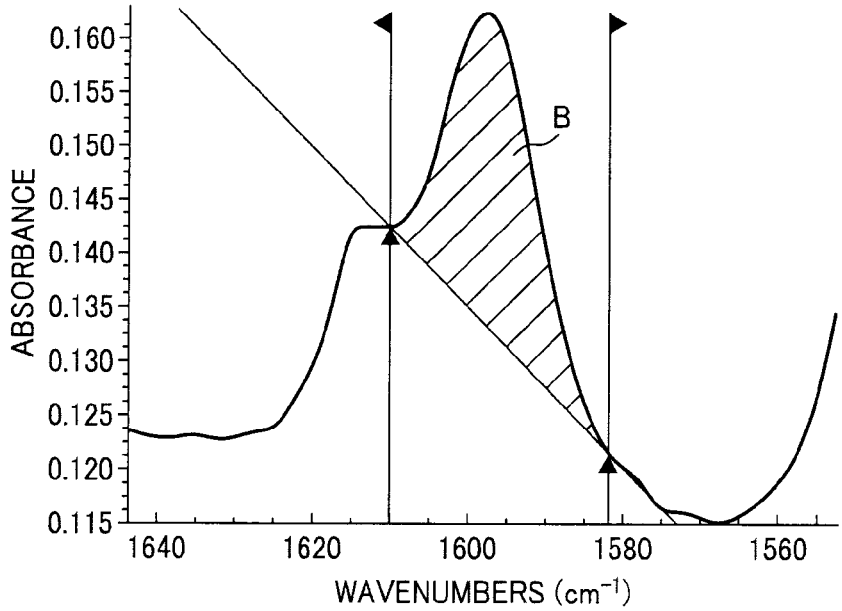
FIG. 4 is a graph illustrating a peak area value B measured based on IR spectrum.

The distance from the contact surface and the cut surface at each measuring point is the side end on the surface side of the measuring area FIGS. 3 and 4 illustrate a portion around 1,700 $cm^{-1}$ of the spectrum obtained by the measuring method described above.

The peak area value A of 1,700 $cm^{-1}$ for use in the present disclosure represents an area of the shoulder portion on the lower wavelength side of the peak having a peak top of 1,733 $cm^{-1}$.

FIG. 3 is a diagram illustrating measuring the area value A.

The area enclosed by three straight lines corresponds to the area value A.

The peak area value B of 1,579 $cm^{-1}$ represents an area of the peak having a peak top of 1,759 $cm^{-1}$.

FIG. 4 is a diagram illustrating measuring the area value B.

The area enclosed by three straight lines corresponds to the area value B.

The wavenumbers and the integrated ranges of the areas at the starting point and the end point of the background when obtaining the values A and B are shown in Table 1.

The calculation method of A0 and B0 is the same as above. These values are obtained by measuring a segment of the cleaning blade with which the acrylate polymer is impregnated according to the Fourier Transform Infrared Spectrometer and Infrared Microscope method (transmission method).

In this method, the Fourier Transform Infrared Spectrometer and Infrared Microscope method (transmission method) is used. Also, Fourier Transform Infrared Spectrometer and Infrared Microscope method (attenuated total reflection method) can be used and the same results can be obtained because the segment is sufficiently thin.

TABLE 1

| | Starting point and end point of background | | Integration range of area | |
|---|---|---|---|---|
| 1,700 $cm^{-1}$ | 1,772 $cm^{-1}$ | 1,650 $cm^{-1}$ | 1,730 $cm^{-1}$ | 1,650 $cm^{-1}$ |
| 1,579 $cm^{-1}$ | 1,610 $cm^{-1}$ | 1,582 $cm^{-1}$ | 1,610 $cm^{-1}$ | 1,582 $cm^{-1}$ |

Ratio of A/B to A0/B0

The ratio of A/B, and A0/B0 are calculated from A, B, A0 and B0 to obtain the ratio of A/B to A0/B0.

The ratio of A/B to A0/B0 approaches to 1 as the impregnation density of the acrylate polymer in the cleaning blade decreases.

In the present disclosure, the place where the ratio reaches 1.1 is determined as the impregnation depth of the acrylate polymer and used to control the impregnation depth.

When the ratio is 1.1 or greater, the impregnation depth of the acrylate polymer is determined as sufficient and thus the impregnation depth can be correctly determined by reading the place where the ratio reaches 1.1.

Figure 10:
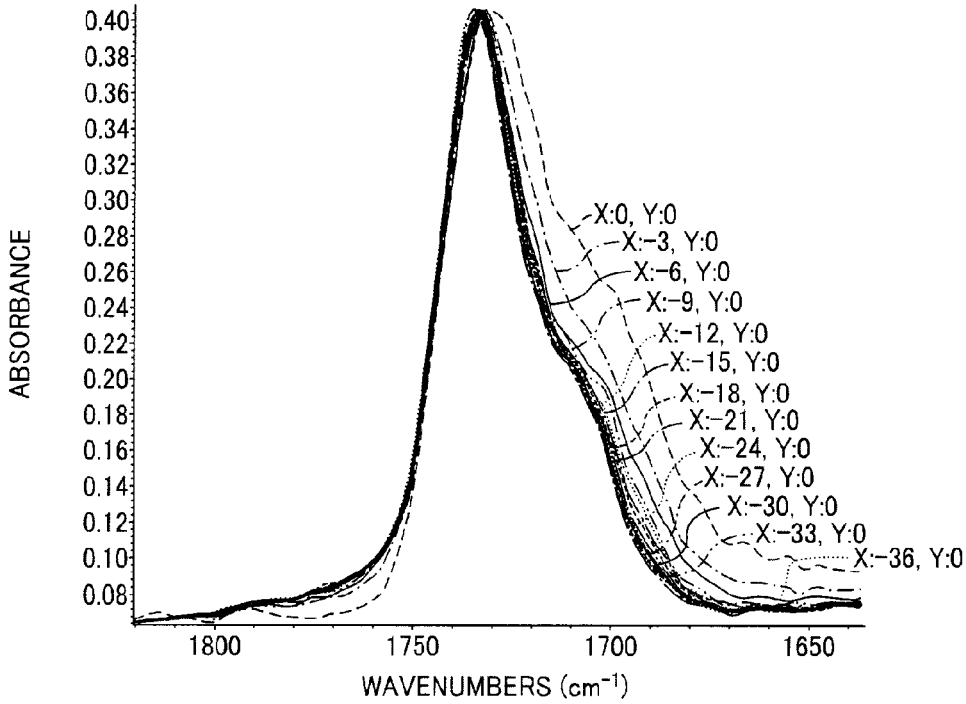
FIG. 10 is an enlarged view around 1,700 $cm^{-1}$ of IR spectrum.

The IR spectrum (around 1,700 $cm^{-1}$) of the cleaning blade of FIG. 9 is illustrated in FIG. 10 as a measuring example.

Figure 11:
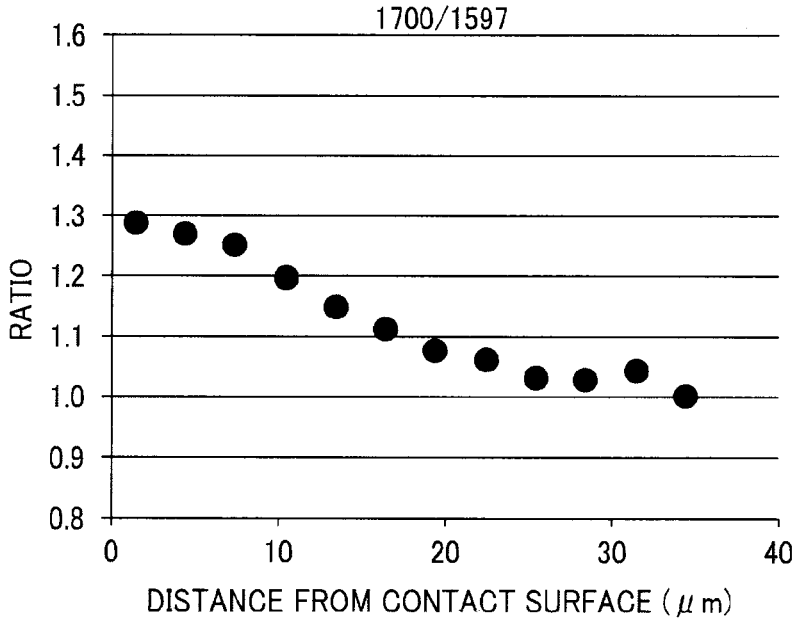
FIG. 11 is a graph illustrating a ratio of A/B to A0/B0 plotted based on the distance from the cut surface.

FIG. 11 is a graph illustrating the ratio of A/B to A0/B0 of the cleaning blade plotted based on the distance from the cut surface.

With regard to this cleaning blade, the impregnation depth of the acrylate polymer is determined as 16.5 μm.

Image Forming Apparatus

Next, a printer employing electrophotography which is one embodiment of the image forming apparatus of the present disclosure is described.

FIG. 5 is a schematic structure view illustrating the main portion of the printer related to this embodiment.

The printer photocopies monochrome images and forms monochrome images based on the image data read by an image reading unit (not shown).

As illustrated in FIG. 5, the printer includes a photoreceptor 3 having a drum form as the image bearing member.

Although the photoreceptor 3 has a drum form in FIG. 5, it may employ a sheet form or an endless belt form.

There are provided around the photoreceptor 3 a charger 4 as a charging device, a development device 5 that develops a latent electrostatic with toner to form a toner image, a transfer device 7 that transfers the toner image to a transfer sheet (transfer body) as a recording medium, a cleaner that removes toner remaining on the photoreceptor 3 after transfer, a lubricant applicator 10 that applies a lubricant to the photoreceptor 3, and a discharging lamp (not shown) that discharges the photoreceptor 3.

The charger 4 is provided around the photoreceptor 3 with a predetermined gap and charges the photoreceptor 3 with a predetermined polarity and a predetermined voltage.

The photoreceptor 3 uniformly charged by the charger 4 is irradiated with a light beam L emitted by an irradiator (not shown) as a latent image formation device according to image data to form a latent electrostatic image on the photoreceptor 3.

The development device 5 has a development roller 51 serving as the development agent bearing member.

A development bias is applied to the development roller 51 by a power source (not shown).

A supply screw 52 and a stirring screw 53 are provided that stir a development agent accommodated in the casing of the development device 5 while transferring the development agent in the opposite direction to each other.

In addition, a doctor 54 is provided to regulate the layer thickness of the development agent borne on the development roller 51.

The toner contained in the development agent that is stirred and transferred by the two screws of the supply screw 52 and the stirring screw 53 is charged with a predetermined polarity.

The development agent is scooped up by the development roller 51, the thickness of the scooped-up development agent is regulated by the doctor 54, and then the toner is attached to a latent image in the development area where the development agent faces the photoreceptor 3.

The cleaning device 6 includes the cleaning blade 62 and additionally a fur brush.

The cleaning blade 62 is in contact with the surface of the photoreceptor 3 against the moving direction of the surface.

The detail of the cleaning blade 62 is the same as described above.

The lubricant applicator 10 includes a solid lubricant 103, a lubricant pressing spring (not shown), a fur brush 101, etc. The fur brush 101 is used as an application brush that applies the solid lubricant 103 to the photoreceptor 103.

The solid lubricant 103 is supported by a bracket (not shown) and pressed toward the side of the fur brush 101 by the lubricant pressing spring (not shown).

The solid lubricant 103 is scraped off by the fur brush 101 that is driven to rotate by the photoreceptor 3 to apply the lubricant to the photoreceptor 3.

The friction index of the surface of the photoreceptor 3 when not forming images is maintained by application of the solid lubricant 103 to the photoreceptor 3 to be 0.2 or less. Any known device such as a corotron, scorotron, and solid state charger can be used as the charger 4.

Among these charging systems, the contact charging system or the non-contact and vicinity provided type charging system is preferable. These systems have advantages such that the charging efficiency is high, ozone is less produced, and size reduction of the machine is possible.

In the case of the contact charging system or the non-contact and vicinity provided type, toner and other materials are transferred from the photoreceptor 3 to the charger 4 and contaminates the charger 4. Therefore, a cleaning mechanism 8 is preferably provided for the charger 4.

Typical illumination devices, for example, a fluorescent lamp, a tungsten lamp, a halogen lamp, a mercury lamp, a sodium lamp, a light emitting diode (LED), a semiconductor laser (LD), and electroluminescence (EL) can be used as the light source for the irradiator or the discharging lamp (both not shown).

In addition, various kinds of optical filters, for example, a sharp cut filter, a band-pass filter, a near infrared filter, a dichroic filter, a coherent filter and a color conversion filter, can be used to irradiate the photoreceptor 3 with light having only a particular wavelength.

Among these light sources, the light emitting diode (LED) and a semiconductor laser (LD) are preferably used since these emit high irradiation energy and have a long wavelength light of from 600 to 800 nm.

Image formation operation at the printer is described next.

When imaging signals for executing printing from an operation unit (not shown) are received, a predetermined voltage or current is sequentially applied to the charger 4 and the development roller 51 at a predetermined timing.

Similarly, a predetermined voltage or current is sequentially applied to the irradiator and the discharging lamp at a predetermined timing.

In addition, in synchronization with the application, the photoreceptor 3 is rotary driven clockwise by a driving motor for the photoreceptor 3 (not shown) as the driving device.

When the photoreceptor 3 rotates clockwise, the surface of the photoreceptor 3 is charged to a predetermined voltage by the charger 4.

The irradiator (not shown) irradiates the photoreceptor 3 with light beam L corresponding to the imaging signals and the irradiated portion of the photoreceptor 3 is discharged to form a latent electrostatic image thereon.

The surface of the photoreceptor 3 on which the latent electrostatic image is formed is slidably abraded by the development roller 51 at the place where the photoreceptor 3 faces the development device 5.

The negatively charged toner on the development roller 51 moves onto the latent electrostatic image by a predetermined development bias applied to the development roller 51 to develop the latent image to form a toner image.

As described above, the latent electrostatic image formed on the photoreceptor 3 is reversely developed by the negatively charged toner by the development device 5 in this embodiment.

In this embodiment, the non-contact charging roller system for the negative positive development in which toner is attached to the place having a lower voltage is described, but the present invention is not limited thereto.

The toner image formed on the photoreceptor 3 is transferred to a transfer paper fed from a paper feeder unit (not shown) to the transfer area formed between the photoreceptor 3 and the transfer device 7 via the portion where an upper registration roller faces a lower registration roller.

At this point, the transfer paper is supplied to a transfer belt 14 in synchronization with the front top of the image at the portion where the upper registration roller faces the lower registration roller.

In addition, a predetermined transfer bias is applied when the image is transferred to the transfer paper.

The transfer paper to which the toner image has been transferred is separated from the photoreceptor 3 and transferred to a fixing device (not shown).

When the transfer paper passes through the fixing device, the toner image is fixed on the transfer paper upon application of heat and pressure and the transfer paper is discharged outside the printer.

On the other hand, the toner remaining on the surface of the photoreceptor 3 after transferring the toner image is removed by the cleaning device 6. Thereafter, the lubricant is applied to the surface of the photoreceptor 3 by the lubricant applicator and then the surface is discharged by the discharging lamp.

The embodiment described above employs a system in which the toner image is directly transferred to the transfer paper but the present invention is not limited thereto.

That is, a system referred to as the intermediate transfer system can be employed in which the toner image is primarily transferred from the photoreceptor 3 to an intermediate transfer belt and the toner image thereon is secondarily transferred to the transfer paper.

In addition, a full color image forming apparatus can be used which employs a typical color image formation system forming color images with multiple development devices 5 corresponding to respective colors.

Furthermore, in this printer, the photoreceptor 3, and other processing devices such as the charger 4, the development device 5, the cleaning device 6 and the lubricant applicator 10 are accommodated in a housing 2 and these are integrally united as a process cartridge 1, which is detachably attachable to the printer.

The photoreceptor 3 and the processing devices are replaceable as the process cartridge 1 in this embodiment, but each unit of the photoreceptor 3, the charger 4, the development device 5, the cleaning device 6 and the lubricant applicator 10 can be replaced with its corresponding new device.

Toner

The toner suitable for the printer is described next.

The toner for use in the printer is preferably a polymerized toner manufactured by a suspension polymerization method, an emulsification polymerization method, or a dispersion polymerization method by which toner having a small particle diameter and a form closer to a true sphere is easily granulated to improve the image quality.

In particular, a polymerized toner having a circularity of 0.97 or higher and a volume average particle diameter of 5.5 μm or less is suitably used.

Images having a high definition can be formed by using a toner having a circularity of 0.97 or higher and a volume average particle diameter of 5.5 μm or less.

The circularity represents the average circularity measured by a flow type particle size analyzer (FPIA-2000, manufactured by Sysmex Corporation).

The specific measuring procedure is as follows: a surfactant serving as a dispersant, preferably 0.1 to 0.5 ml of an alkylbenzenesulfonic acid salt is added to 100 to 150 ml of water from which solid impurities have been removed; about 0.1 to about 0.5 g of a sample (toner) to be measured is added to the solution; thereafter, the suspension in which the toner is dispersed is subject to an ultrasonic dispersion treatment for about 1 to about 3 minutes such that the concentration of the liquid dispersion is 3,000 to 10,000 particles per micro litter; and the resultant is set in the instrument mentioned above to measure the form and the distribution of the toner.

Figure 6A:
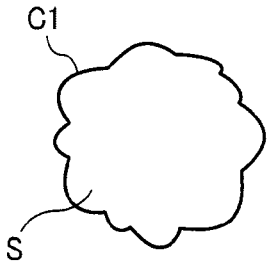
FIG. 6A is a view illustrating a projected area S of a toner particle and its circumference length C1.
Figure 6B:
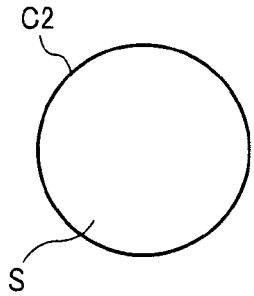
FIG. 6B is a view illustrating the circumference length C2 of a true sphere having an area equal to the projected area S illustrated in FIG. 6A.

Based on the measuring results, the average of C2/C1 is calculated and determined as the circularity of the toner, where C1 represents the circumference length of the projected toner particle as illustrated in FIG. 6A, and C2 represents the circumference length of a true circle illustrated in FIG. 6B having an area S, which is the projected area of the toner particle.

The volume average particle diameter can be obtained by a Coulter Counter method.

To be specific, data of number distribution and volume distribution of the toner measured by Coulter Multisizer 2e (manufactured by Coulter Beckman Inc.) are sent to a home computer via an interface (available from Nikkaki bios).

In detail, 1% NaCl aqueous solution using primary sodium chloride is prepared as an electrolyte; Add 0.1 to 5 ml of a surface active agent (preferably alkyl benzene sulfonate salt) as a dispersant to 100 to 150 ml of an electrolytic aqueous solution; Furthermore, add 2 to 20 mg of the toner sample to be measured followed by dispersion by an ultrasonic dispersion device for about one to three minutes; Pour 100 to 200 ml of the electrolyte into a beaker; and add the solution after the dispersion treatment to the beaker such that a predetermined concentration is obtained followed by measuring by the Coulter Multisizer 2e.

An aperture of 100 μm is used to measure the particle diameter of 50,000 toner particles. The whole range is a particle diameter of from 2.00 to less than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to less than 40.30 μm. The toner particles having a particle diameter of from 2.00 to 32.0 μm are measured. The volume average particle diameter is calculated using the following relationship:

$$\text{Volume Average Particle Diameter}=\Sigma XfV/\Sigma fV$$

In the relationship, X represents a representative particle diameter, V represents a corresponding volume at the representative particle diameter of each channel, and f represents the number of particles at each channel.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present disclosure is described in detail with reference to Examples and Comparative Examples.

A durability test is conducted changing the material, the layer thickness and impregnation treatment of the surface layer 623.

A polyurethane cleaning blade used in imagio Neo C4500 manufactured by Ricoh Co., Ltd. is used as the elastic blade 622.

Composition of Acrylate Material

Acrylate materials 1 to 3 are prepared to form acrylate polymers.

| Acrylate Material 1 | |
|---|---|
| KAYARAD DPCA-120, manufactured by Nippon Kayaku Corporation | 25 parts |
| I-184, manufactured by Ciba Spezialitatenchemie AG | 1 part |
| 2-butanol | 74 parts |
| **Acrylate Material 2** | |
| KAYARAD TMPTA, manufactured by Nippon Kayaku Corporation | 25 parts |
| I-184, manufactured by Ciba Spezialitatenchemie AG | 1 part |
| 2-butanol | 74 parts |
| **Acrylate Material 3** | |
| KAYARAD R-526 (manufactured by Nippon Kayaku Corporation) | 25 parts |
| I-184, manufactured by Ciba Spezialitatenchemie AG | 1 part |
| 2-butanol | 74 parts |

Measuring Depth of Impregnation of Acrylate Polymer

Two of the cleaning blades manufactured in the same conditions are prepared for each of Examples 1 to 6 and Comparative Examples 1 to 4. A segment having a thickness of 400 nm at the center as to the longitudinal direction is prepared by CRYO MICROTOME from one of the two cleaning blades, and placed on silicon wafer to measure the layer thickness of the surface layer of the contact surface with an optical microscope and a scanning electron microscope (SEM).

In addition, a Fourier Transform Infrared Spectrometer and Infrared Microscope method (transmission method) is used to measure the segment from the contact surface toward inside to measure the level of the impregnation of the acrylate polymer.

The level of the impregnation of the polyacrylate polymer is evaluated at the place where the ratio [(A/B)/(A0/B0)] of A/B to A0/B0 reaches 1.1.

Example 1

A surface layer is formed at the front end of the contact portion by spray coating.

The used spray device is PC WIDE 308 (manufactured by Olympos). The discharging amount from the spray gun of the spray device is adjusted to obtain a predetermined layer thickness by moving the spray gun at 7 mm/s with a pressure of 0.5 MPa from 40 mm away from the front end of the contact portion.

Thereafter, the surface is left undone for five minutes followed by 10 minute vacuum drying at 30° C. followed by irradiation of UV light (1,000 mj/cm$^2$) to polymerize the impregnated acylate monomers while forming the surface layer.

The drugs for use in the spray coating liquid are subject to vacuum freeze-degassing treatment to remove oxygen.

Spray coating and drying are conducted in an environment in which the oxygen concentration is 100 ppm or less.

The results are as follows:

| Acrylate polymer 1 (polymerized Acrylate material 1) | |
|---|---|
| Thickness of surface layer | 1 μm |
| Impregnation depth of Acrylate polymer 1 | 7.5 μm |

Example 2

A surface layer is formed on the front end of the contact portion in the same manner as in Example 1 except that Acrylate material 2 is used instead of Acrylate material 1.

The results are as follows:

| Acrylate polymer 2 (polymerized Acrylate material 2) | |
|---|---|
| Thickness of surface layer | 0.6 μm |
| Impregnation depth of Acrylate polymer 2 | 10.5 μm |

Example 3

A surface layer is formed on the front end of the contact portion is formed in the same manner as in Example 1 except that Acrylate material 3 is used instead of Acrylate material 1.

The results are as follows:

| Acrylate polymer 3 (polymerized Acrylate material 3) | |
|---|---|
| Thickness of surface layer | 0.6 μm |
| Impregnation depth of Acrylate polymer 3 | 13.5 μm |

Example 4

The pressure in a glass container containing the elastic blade is reduced to 10 mmHg and Acrylate material 1 is poured into the container such that the elastic blade is impregnated with Acrylate material 1 at a desired portion while maintaining the reduced pressure state and this state is held for 30 seconds.

The pressure inside the container is made back to a normal pressure and Acrylate material 1 on the surface of the elastic blade is wiped off by Microwipe. Thereafter, the surface layer is dried and irradiated with UV in the same manner as in Example 1 to form a surface layer and polymerize the impregnated polymerizable acrylate monomer.

The results are as follows:

| Acrylate polymer 1 (polymerized Acrylate material 1) | |
|---|---|
| Thickness of surface layer | 0.1 μm |
| Impregnation depth of Acrylate polymer 1 | 31.5 μm |

Example 5

A surface layer is formed and the impregnated polymerizable acrylate monomer is polymerized by drying and irradiation of UV in the same manner as in Example 4 except that Acrylate material 1 is poured into the container and the state is held for two minutes.

The results are as follows:

| Acrylate polymer 1 (polymerized Acrylate material 1) | |
|---|---|
| Thickness of surface layer | 0.1 μm |
| Impregnation depth of Acrylate polymer 1 | 85.5 μm |

Example 6

A cleaning blade is manufactured in the same manner as in Example 3 except that UV irradiation is conducted in an oxygen concentration of 1.8%.

The results are as follows:

| Acrylate polymer 3 (polymerized Acrylate material 3) | |
|---|---|
| Thickness of surface layer | 0.6 μm |
| Impregnation depth of acrylate polymer 3 | 10.5 μm |

Comparative Example 1

A non-treated elastic blade is used for the cleaning blade.

Comparative Example 2

A cleaning blade is manufactured in the same manner as in Example 1 except that 74 parts of 2-butanol of Acrylate material 1 is changed to 140 parts.

The results are as follows:

| Acrylate polymer 1 (polymerized Acrylate material 1) | |
|---|---|
| Thickness of surface layer | 0.1 μm |
| Impregnation depth of acrylate polymer 1 | 4.5 μm |

Comparative Example 3

A surface layer is formed and the impregnated polymerizable acrylate monomer is polymerized by drying and irradiation of UV in the same manner as in Example 4 except that Acrylate material 3 is used instead of Acrylate material 1, Acrylate material 3 is poured into the container and the state is held for 20 minutes.

The results are as follows:

| Acrylate polymer 3 (polymerized Acrylate material 3) | |
|---|---|
| Thickness of surface layer | 0.1 μm |
| Impregnation depth of acrylate polymer 3 | 130.5 μm |

Comparative Example 4

A cleaning blade is manufactured in the same manner as in Example 3 except that 74 parts of 2-butanol of Acrylate material 3 is changed to 100 parts, and a surface layer is formed and the impregnated polymerizable acrylate monomer is polymerized by spray coating, drying, and UV irradiation in atmosphere.

The results are as follows:

| Acrylate polymer 3 (polymerized Acrylate material 3) | |
|---|---|
| Thickness of surface layer | 0.5 μm |
| Impregnation depth of acrylate polymer 3 | 1.5 μm |

Verification Test

The structure of the image forming apparatus for use in a verification test is described next.

The cleaning blade is attached to a multi-functional color machine (imagio Neo C4500, manufactured by Ricoh Co., Ltd.) to manufacture the image forming apparatuses for Examples 1 to 6, and Comparative Examples 1 to 4.

In addition, a polymerized toner is used.

The characteristics of the toner are as follows.

| | |
|---|---|
| Mother toner particles (Circularity: 0.98 Average particle diameter: 4.9 μm) | 97 parts |
| External additive: Small particle silica (H2000, manufactured by Clariant K.K) | 1.5 parts |
| Small particle titan (MT-150AI, manufactured by Tayca Corporation) | 0.5 parts |
| Large particle silica (UFP-30H, manufactured by Denki Kagaku kogyo Kabushiki Kaisha) | 1.0 part |

The verification test is conducted under the following condition:

Laboratory environment: 21° C, 65% RH

Paper passing condition: Chart having an image area ratio of 5%

Print three charts per job on A4 landscape sheets until the number of prints reaches 50,000.

The evaluation items are as follows:

Evaluation Items

Cleaning performance observed by naked eyes: E (Excellent), G (Good), F (Fair), P (Poor), and EP (extremely poor)

Image for evaluation: Vertical band pattern (along the paper passing direction) having a width of 43 mm and three band chart output on 20 A4 sheets (landscape)

Figure 8A:
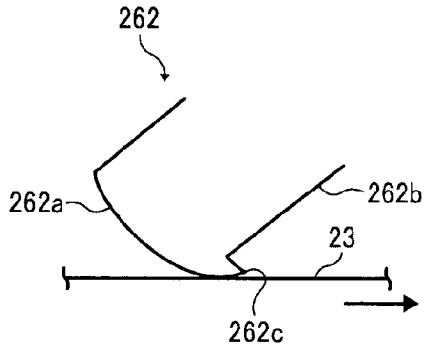
FIG. 8A PRIOR ART
FIG. 8 is a diagram illustrating a structure of a typical cleaning blade.
Figure 8B:
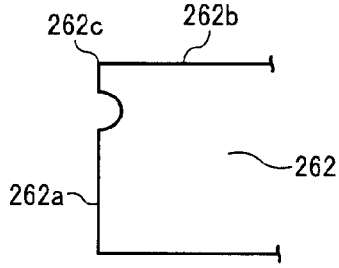
FIG. 8B PRIOR ART
Figure 8C:
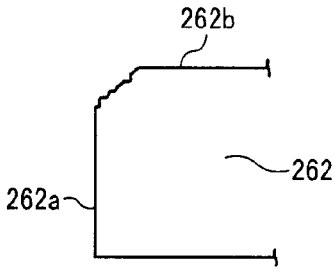
FIG. 8C PRIOR ART

Cleaning blade edge abrasion width, abrasion state: Abrasion width and abrasion state seen from the bottom of the cleaning blade as illustrated in FIG. 8

The results of the verification test for the cleaning blades of Examples 1 to 6 and Comparative Examples 1 to 4 are shown below.

The layer thickness of the surface layer is measured by observing with a microscope (VHX-100, manufactured by Keyence Corporation) a cross section of the other of the two elastic blades.

The sample is made by cutting a cross section by trimming razor for manufacturing SEM sample (manufactured by NISSHIN EM CORPORATION).

TABLE 2

| Examples | Thickness of surface layer (μm) | Level of impregnation (μm) | Results: Cleaning performance | Results: Abrasion width | Results: State of abrasion |
|---|---|---|---|---|---|
| Example 1 | 1 | 7.5 | E | 5 | Abrasion starts from edge |
| Example 2 | 0.6 | 10.5 | E | 5 | Abrasion starts from edge |
| Example 3 | 0.6 | 13.5 | G | 8 | Abrasion starts from edge |
| Example 4 | 01 | 31.5 | G | 12 | Abrasion starts from edge |
| Example 5 | 0.1 | 85.5 | G | 15 | Abrasion starts from edge |
| Example 6 | 0.6 | 10.5 | G | 12 | Abrasion starts from edge |
| Comparative Example 1 | 0 | 0 | F | 30 | Hollow |
| Comparative Example 2 | 0.1 | 4.5 | F | 30 | Hollow |
| Comparative Example 3 | 0.1 | 130.5 | P | 40 | Hollow |
| Comparative Example 4 | 0.5 | 1.5 | EP | 60 | Chip-off at many places |

Table 2 shows the results of the verification test of Examples 1 to 6 and Comparative Examples 1 to 4.

In Examples 1 to 6, good cleaning performance is maintained over an extended period of time.

The untreated blade of Comparative Example 1 is hollowed by abrasion but no hollow portion but clean abrasion is seen in Examples 1 to 6.

In addition, because the abrasion width is narrow in comparison with the untreated blade, the abrasion resistance is found to be improved.

To the contrary, similar to the untreated blade, hollow portions are observed in Comparative Examples 2 and 3 and the abrasion width is almost the same as the untreated blade.

In addition, in Comparative Example 4, chip-off is observed at a great number of places of the cleaning blade so that the cleaning property extremely deteriorates.

Another durability test is conducted changing the material, the layer thickness and impregnation treatment of the surface layer 623 for Examples 7 to 12 and Comparative Examples 5 to 9.

Elastic Blade

A polyurethane cleaning blade used in imagio Neo C4500 manufactured by Ricoh Co., Ltd. is used as the elastic blade 622.

Example 7

Surface Layer

A surface layer is formed at the front end of the contact portion by spray coating in Example 7.

The used spray device is PC WIDE 308 (manufactured by Olympos). The discharging amount from the spray gun of the spray device is adjusted to obtain a predetermined layer thickness by moving the spray gun at 7 mm/s with a pressure of 0.5 MPa from 40 mm away from the front end of the contact portion. Thereafter, the surface is left undone for five minutes followed by 10 minute vacuum drying at 30° C. followed by irradiation of UV light (1,000 mj/cm$^2$) to polymerize the impregnated acylate monomers while forming the surface layer.

The drug for use in the spray coating liquid is subject to vacuum freeze-degassing treatment to remove oxygen. Spray coating and drying are conducted in an environment in which the oxygen concentration is 100 ppm or less.

| Acrylate Material 4 | |
|---|---|
| KAYARAD DPCS-120, manufactured by Nippon Kayaku Corporation | 27 parts |
| I-184, manufactured by Ciba Spezialitatenchemie AG | 1 part |
| 2-butanol | 72 parts |

| Acrylate Material 5 | |
|---|---|
| KAYARAD TMPTA, manufactured by Nippon Kayaku Corporation | 27 parts |
| I-184, manufactured by Ciba Spezialitatenchemie AG | 1 part |
| 2-butanol | 72 parts |

| Acrylate Material 6 | |
|---|---|
| KAYARAD R-526 (manufactured by Nippon Kayaku Corporation) | 27 parts |
| I-184, manufactured by Ciba Spezialitatenchemie AG | 1 part |
| 2-butanol | 72 parts |

Two of the cleaning blades manufactured in the same conditions are prepared for each of Examples 7 to 12 and Comparative Examples 5 to 9. A segment having a thickness of 400 nm at the center as to the longitudinal direction is prepared by CRYO MICROTOME from one of the two cleaning blades, and placed on silicon wafer to measure the layer thickness of the surface layer of the cut surface with an optical microscope and a scanning electron microscope (SEM). In addition, a Fourier Transform Infrared Spectrometer and Infrared Microscope method (transmission method) is used to measure the segment from the cut surface toward inside to measure the level of the impregnation of the acrylate polymer.

The level of the impregnation of the polyacrylate polymer is evaluated at the place where the ratio [(A/B)/(A0/B0)] of A/B to A0/B0 reaches 1.1.

Example 7

| Acrylate polymer 4 (polymerized Acrylate material 4) | |
|---|---|
| Thickness of surface layer | 0.9 μm |
| Impregnation depth of Acrylate polymer 4 | 6.5 μm |

Example 8

| Acrylate polymer 5 (polymerized Acrylate material 5) | |
|---|---|
| Thickness of surface layer | 0.5 μm |
| Impregnation depth of Acrylate polymer 4 | 11.5 μm |

Example 9

| Acrylate polymer 6 (polymerized Acrylate material 6) | |
|---|---|
| Thickness of surface layer | 0.5 μm |
| Impregnation depth of acrylate polymer 6 | 15.5 μm |

Example 10

The pressure in a glass container containing the elastic blade is reduced to 10 mmHg and Acrylate material 4 is poured into the container such that the elastic blade is impregnated with Acrylate material 4 at a desired portion while maintaining the reduced pressure state and this state is held for 30 seconds.

The pressure inside the container is made back to a normal pressure and Acrylate material 4 on the surface of the elastic blade is wiped off by Microwipe. Thereafter, the surface layer is dried and irradiated with UV in the same manner as in Example 7 to form a surface layer and polymerize the impregnated polymerizable acrylate monomer.

| | |
|---|---|
| Thickness of surface layer | 0.2 μm |
| Impregnation depth of acrylate polymer | 45.5 μm |

Example 11

A surface layer is formed and the impregnated polymerizable acrylate monomer is polymerized by drying and irradiation of UV in the same manner as in Example 10 except that Acrylate material 4 is poured into the container and the state is held for two minutes.

| | |
|---|---|
| Thickness of surface layer | 0.1 μm |
| Impregnation depth of acrylate polymer | 92.5 μm |

Example 12

A cleaning blade is manufactured in the same manner as in Example 9 except that UV irradiation is conducted in an oxygen concentration of 1.8%.

| | |
|---|---|
| Thickness of surface layer | 0.5 μm |
| Impregnation depth of acrylate polymer | 11.5 μm |

Comparative Example 5

A non-treated elastic blade is used for the cleaning blade.

Comparative Example 6

A cleaning blade is manufactured in the same manner as in Example 7 except that 74 parts of 2-butanol of Acrylate material 6 is changed to 140 parts.

| | |
|---|---|
| Thickness of surface layer | 0.1 μm |
| Impregnation depth of acrylate polymer | 4.5 μm |

Comparative Example 7

A surface layer is formed and the impregnated polymerizable acrylate monomer is polymerized by drying and irradiation of UV in the same manner as in Example 10 except that Acrylate material 6 is used instead of Acrylate material 4 and Acrylate material 6 is poured into the container and the state is held for 20 minutes.

| | |
|---|---|
| Thickness of surface layer | 0.1 μm |
| Impregnation depth of acrylate polymer | 115.5 μm |

Comparative Example 4

A cleaning blade is manufactured in the same manner as in Example 9 except that 72 parts of 2-butanol of Acrylate material 6 is changed to 120 parts, and a surface layer is formed and the impregnated polymerizable acrylate monomer is polymerized by spray coating, drying, and UV irradiation in atmosphere.

| | |
|---|---|
| Thickness of surface layer | 0.6 μm |
| Impregnation depth of acrylate polymer | 0.5 μm |

Comparative Example 9

A cleaning blade is manufactured in the same manner as in Example 2 of JP 2602898 except for the elastic blade.

| | |
|---|---|
| Thickness of surface layer | 15 μm |
| Impregnation depth of acrylate polymer | 0.5 μm |

The structure of the image forming apparatus for use in a verification test is described next.

The cleaning blade is attached to a multi-functional color machine (imagio Neo C4500, manufactured by Ricoh Co., Ltd.) to manufacture the image forming apparatuses for Examples 7 to 12, and Comparative Examples 5 to 9. In addition, a polymerized toner is used. The characteristics of the toner are as follows.

| | |
|---|---|
| Mother toner particles (Circularity: 0.98, Average particle diameter: 4.9 μm) | 97 parts |
| External additive: Small particle silica (H2000, manufactured by Clariant K.K) | 1.5 parts |
| Small particle titan (MT-150AI, manufactured by Tayca Corporation) | 0.5 parts |
| Large particle silica (UFP-30H, manufactured by Denki Kagaku kogyo Kabushiki Kaisha) | 1.0 part |

The verification test is conducted under the following condition:

Laboratory environment: 21° C., 65% RH

Paper passing condition: Chart having an image area ratio of 5%

Print three charts per job on landscape A4 sheets until the number of printed sheets reaches 50,000.

The evaluation items are as follows:

Evaluation Items

Cleaning performance observed by naked eyes: E (Excellent), G (Good), F (Fair), P (Poor), and EP (extremely poor)

Image for evaluation: Vertical band pattern (against the paper passing direction) having a width of 43 mm and three band chart output on 20 A4 sheets (landscape)

Cleaning blade edge abrasion width, abrasion state: Abrasion width and abrasion state seen from the bottom of the cleaning blade as illustrated in FIG. 8

The results of the verification test for the cleaning blades of Examples 7 to 12 and Comparative Examples 5 to 9 are shown below.

The layer thickness of the surface layer is measured by observing with a microscope (VHX-100, manufactured by Keyence Corporation) a cross section of the other of the two elastic blades.

The sample is made by cutting a cross section by trimming razor for manufacturing SEM sample (manufactured by NISSHIN EM CORPORATION).

TABLE 3

| Examples | Thickness of surface layer (μm) | Level of impregnation (μm) | Results: Cleaning performance | Results: Abrasion width | Results: State of abrasion |
|---|---|---|---|---|---|
| Example 7 | 0.9 | 6.5 | G | 9 | Abrasion starts from edge |
| Example 8 | 0.5 | 11.5 | E | 4 | Abrasion starts from edge |
| Example 9 | 0.5 | 15.5 | E | 5 | Abrasion starts from edge |
| Example 10 | 0.2 | 45.5 | E | 5 | Abrasion starts from edge |
| Example 11 | 0.1 | 92.5 | G | 13 | Abrasion starts from edge |
| Example 12 | 0.5 | 11.5 | G | 15 | Abrasion starts from edge |
| Comparative Example 5 | 0 | 0 | F | 30 | Hollow |
| Comparative Example 6 | 0.1 | 4.5 | F | 30 | Hollow |
| Comparative Example 7 | 0.1 | 115.5 | P | 50 | Hollow |
| Comparative Example 8 | 0.6 | 0.5 | EP | 80 | Chip-off at many places |
| Comparative Example 9 | 15.0 | 0.5 | EP | 75 | Chip-off at many places |

Table 3 shows the results of the verification test of Examples 7 to 12 and Comparative Examples 5 to 9.

In Examples 1 to 6, good cleaning performance is maintained over an extended period of time.

The untreated blade of Comparative Example 5 is hollowed by abrasion but no hollow portion but clean abrasion is seen in Examples 7 to 12.

In addition, because the abrasion width is narrow in comparison with the untreated blade, the abrasion resistance is found to be improved.

To the contrary, similar to the untreated blade, hollow portions are observed in Comparative Examples 2 and 3 and the abrasion width is almost the same as the untreated blade.

In addition, in Comparative Example 8, chip-off is observed at a great number of portions of the cleaning blade so that the cleaning property extremely deteriorates. Similarly, in Comparative Example 9, chip-off is observed at a great number of portions of the cleaning blade so that the cleaning property extremely deteriorates. The term "impregnation" is used in JP 2602898 (for example, Example 2). The depth of the impregnation measured for Comparative Example 9 according to the method described above in this specification is 0.5 μm, meaning the cleaning blade is hardly impregnated with the acrylate polymer.

A durability test is conducted changing the material, the layer thickness and impregnation treatment of the surface layer 623.

Elastic Blade

A polyurethane cleaning blade used in imagio Neo C4500 manufactured by Ricoh Co., Ltd. is used as the elastic blade 622.

Surface Layer

Example 13

A surface layer is formed at the front ends of the contact surface and the cut surface by spray coating in Example 13.

The used spray device is PC WIDE 308 (manufactured by Olympos). The discharging amount from the spray gun of the spray device is adjusted to obtain a predetermined layer thickness by moving the spray gun at 7 mm/s with a pressure of 0.5 MPa from 40 mm away from the front end of the contact portion. Thereafter, the surface is left undone for five minutes followed by 10 minute vacuum drying at 30° C. followed by irradiation of UV light (1,000 mj/cm$^2$) to polymerize the impregnated acylate monomers while forming the surface layer.

The drug for use in the spray coating liquid is vacuum freeze-degassed to remove oxygen. Spray coating and drying are conducted in an environment in which the oxygen concentration is 100 ppm or less.

| Acrylate Material 7 | |
|---|---|
| KAYARAD DPCS-120, manufactured by Nippon Kayaku Corporation | 20 parts |
| I-184, manufactured by Ciba Spezialitatenchemie AG | 1 part |
| 2-butanol | 79 parts |

| Acrylate Material 8 | |
|---|---|
| KAYARAD TMPTA, manufactured by Nippon Kayaku Corporation | 20 parts |
| I-184, manufactured by Ciba Spezialitatenchemie AG | 1 part |
| 2-butanol | 79 parts |

| Acrylate Material 9 | |
|---|---|
| KAYARAD R-526 (manufactured by Nippon Kayaku Corporation) | 20 parts |
| I-184, manufactured by Ciba Spezialitatenchemie AG | 1 part |
| 2-butanol | 79 parts |

Two of the cleaning blades manufactured in the same conditions are prepared for each of Examples 13 to 22 and Comparative Examples 10 to 13. A segment having a thickness of 400 nm at the center as to the longitudinal direction is prepared by CRYO MICROTOME from one of the two cleaning blades, and placed on silicon wafer to measure the layer thickness of the surface layer of the cut surface with an optical microscope and a scanning electron microscope (SEM).

In addition, a Fourier Transform Infrared Spectrometer and Infrared Microscope method (transmission method) is used to measure the segment from the contact surface toward inside to measure the level of the impregnation of the acrylate polymer at the contact surface.

Similarly, a Fourier Transform Infrared Spectrometer and Infrared Microscope method (transmission method) is used to measure the segment from the cut surface toward inside to measure the level of the impregnation of the acrylate polymer at the cut surface.

The level of the impregnation of the polyacrylate polymer is evaluated at the place where the ratio [(A/B)/(A0/B0)] of A/B to A0/B0 reaches 1.1.

Example 13

| Acrylate polymer 7 (polymerized Acrylate material 7) | |
|---|---|
| Thickness of surface layer | 0.9 μm |
| Thickness of surface layer | 0.8 μm |
| X: | 6 μm |
| Y: | 8 μm |

Example 14

| Acrylate polymer 8 (polymerized Acrylate material 8) | |
|---|---|
| Thickness of surface layer | 0.5 μm |
| Thickness of surface layer | 0.6 μm |
| X: | 8 μm |
| Y: | 13 μm |

Example 15

| Acrylate polymer 9 (polymerized Acrylate material 9) | |
|---|---|
| Thickness of surface layer | 0.5 μm |
| Thickness of surface layer | 0.4 μm |
| X: | 10 μm |
| Y: | 17 μm |

Example 16

The pressure in a glass container containing the elastic blade is reduced to 10 mmHg and Acrylate material 7 is poured into the container such that the elastic blade is impregnated with Acrylate material 7 at the front ends of the contact surface and the cut surface while maintaining the reduced pressure state and this state is held for 30 seconds.

The pressure inside the container is made back to a normal pressure and Acrylate material 7 on the surface of the elastic blade is wiped off by Microwipe. Thereafter, the surface layer is dried and irradiated with UV in the same manner as in Example 13 to form a surface layer and polymerize the impregnated polymerizable acrylate monomer.

| | |
|---|---|
| Thickness of surface layer of contact surface | 0.1 μm |
| Thickness of surface layer of cut surface | 0.1 μm |
| X: | 20 μm |
| Y: | 31 μm |

Example 17

A surface layer is formed and the impregnated polymerizable acrylate monomer is polymerized by drying and irradiation of UV in the same manner as in Example 16 except that Acrylate material 7 is poured into the container and the state is held for two minutes.

| | |
|---|---|
| Thickness of surface layer of contact surface | 0.1 μm |
| Thickness of surface layer of cut surface | 0.1 μm |
| X: | 90 μm |
| Y: | 98 μm |

Example 18

A cleaning blade is manufactured in the same manner as in Example 15 except that UV irradiation is conducted in an oxygen concentration of 1.8%.

| | |
|---|---|
| Thickness of surface layer of contact surface | 0.5 μm |
| Thickness of surface layer of cut surface | 0.6 μm |
| X: | 8 μm |
| Y: | 12 μm |

Example 19

A cleaning blade is manufactured in the same manner as in Example 16 except that the impregnated portion is limited to the contact portion of the cleaning blade manufactured in Example 13 and the holding time is changed to one minute.

| | |
|---|---|
| Thickness of surface layer of contact surface | 1.1 μm |
| Thickness of surface layer of cut surface | 0.8 μm |
| X: | 65 μm |
| Y: | 8 μm |

Example 20

A cleaning blade is manufactured in the same manner as in Example 16 except that the impregnated portion is limited to the cut portion of the cleaning blade manufactured in Example 14, Acrylate material 8 is used instead, and the holding time is changed to one minute.

| | |
|---|---|
| Thickness of surface layer of contact surface | 0.5 μm |
| Thickness of surface layer of cut surface | 0.9 μm |
| X: | 8 μm |
| Y: | 74 μm |

Example 21

A cleaning blade is manufactured in the same manner as in Example 19 except that holding time is changed to two minutes.

| | |
|---|---|
| Thickness of surface layer of contact surface | 1.2 μm |
| Thickness of surface layer of cut surface | 0.8 μm |
| X: | 90 μm |
| Y: | 8 μm |

Example 22

A cleaning blade is manufactured in the same manner as in Example 20 except that holding time is changed to two minutes.

| | |
|---|---|
| Thickness of surface layer of contact surface | 0.5 μm |
| Thickness of surface layer of cut surface | 1.1 μm |
| X: | 8 μm |
| Y: | 99 μm |

Comparative Example 10

A non-treated elastic blade is used as the cleaning blade.

Comparative Example 11

A cleaning blade is manufactured in the same manner as in Example 13 except that 79 parts of 2-butanol of Acrylate material 7 is changed to 150 parts.

| | |
|---|---|
| Thickness of surface layer of contact surface | 0.1 μm |
| Thickness of surface layer of cut surface | 0.1 μm |
| X: | 4 μm |
| Y: | 4 μm |

Comparative Example 12

A surface layer is formed and the impregnated polymerizable acrylate monomer is polymerized by drying and irradiation of UV in the same manner as in Example 16 except that Acrylate material 9 is used instead of Acrylate material 7 and Acrylate material 9 is poured into the container and the state is held for 20 minutes.

| | |
|---|---|
| Thickness of surface layer of contact surface | 0.1 μm |
| Thickness of surface layer of cut surface | 0.1 μm |
| X: | 150 μm |
| Y: | 175 μm |

Comparative Example 13

A cleaning blade is manufactured in the same manner as in Example 15 except that 79 parts of 2-butanol of Acrylate material 9 is changed to 100 parts and a surface layer is formed and the impregnated polymerizable acrylate monomer is polymerized by spray coating, drying, and UV irradiation in atmosphere.

| | |
|---|---|
| Thickness of surface layer of contact surface | 0.3 μm |
| Thickness of surface layer of cut surface | 0.4 μm |
| X: | 2 μm |
| Y: | 2 μm |

The structure of the image forming apparatus for use in a verification test is described next.

The cleaning blade is attached to a multi-functional color machine (imagio Neo C4500, manufactured by Ricoh Co., Ltd.) to manufacture the image forming apparatuses for Examples 13 to 22, and Comparative Examples 10 to 13.

In addition, a polymerized toner is used.

The characteristics of the toner are as follows.

| | |
|---|---|
| Mother toner particles (Circularity: 0.98, Average particle diameter: 4.9 μm) | 97 parts |
| External additive: Small particle silica (H2000, manufactured by Clariant K.K) | 1.5 parts |
| Small particle titan (M150AI, manufactured by Tayca Corporation) | 0.5 parts |
| Large particle silica (UFP-30H, manufactured by Denki Kagaku kogyo Kabushiki Kaisha) | 1.0 part |

The verification test is conducted under the following condition:

Laboratory environment: 21° C., 65% RH

Paper passing condition: Chart having an image area ratio of 5%

Print three charts per job until 50,000 A4 landscape sheets

The evaluation items are as follows:

Evaluation Items

Cleaning performance observed by naked eyes: S (Super), E (Excellent), G (Good), F (Fair), P (Poor), and EP (extremely poor)

Image for evaluation: Vertical band pattern (against the paper passing direction) having a width of 43 mm and three band chart output on 20 A4 sheets (landscape)

Figure 7:
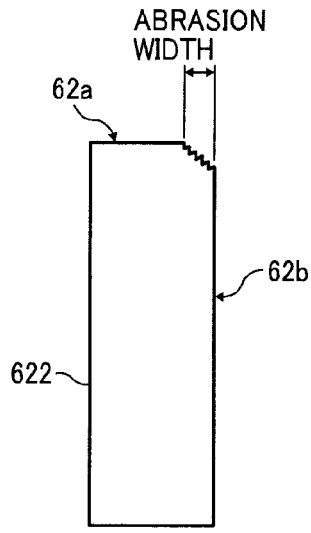
FIG. 7 is a bottom view illustrating abrasion width and abrasion state of a cleaning blade.

Cleaning blade edge abrasion width, abrasion state: Abrasion width and abrasion state seen from the bottom of the cleaning blade as illustrated in FIG. 7

The results of the verification test for the cleaning blades of Examples 13 to 22 and Comparative Examples 10 to 13 are shown below.

The layer thickness of the surface layer is measured by observing with a microscope (VHX-100, manufactured by Keyence Corporation) a cross section of the other of the two elastic blades.

The sample is made by cutting a cross section by trimming razor for manufacturing SEM sample (manufactured by NISSHIN EM CORPORATION).

TABLE 4

| Examples | Thickness of contact surface (μm) | Thickness of cut surface (μm) | X (μm) | Y (μm) | X/Y |
|---|---|---|---|---|---|
| Example 13 | 0.9 | 0.8 | 6 | 8 | 0.75 |
| Example 14 | 0.5 | 0.6 | 8 | 13 | 0.62 |
| Example 15 | 0.5 | 0.4 | 10 | 17 | 0.59 |
| Example 16 | 0.1 | 0.1 | 20 | 31 | 0.65 |
| Example 17 | 0.1 | 0.1 | 90 | 98 | 0.92 |
| Example 18 | 0.5 | 0.6 | 8 | 12 | 0.67 |
| Example 19 | 1.1 | 0.8 | 65 | 8 | 8.13 |
| Example 20 | 0.5 | 0.9 | 8 | 74 | 0.11 |
| Example 21 | 1.2 | 0.8 | 90 | 8 | 11.25 |
| Example 22 | 0.5 | 1.1 | 8 | 99 | 0.08 |
| Comparative Example 10 | 0.0 | 0.0 | 0 | 0 | 0.00 |
| Comparative Example 11 | 0.1 | 0.1 | 4 | 4 | 1.00 |
| Comparative Example 12 | 0.1 | 0.1 | 150 | 175 | 0.86 |
| Comparative Example 13 | 0.3 | 0.4 | 2 | 2 | 1.00 |

TABLE 4-continued

| Examples | Results | | |
|---|---|---|---|
| | Cleaning performance | Abrasion width (μm) | State of abrasion |
| Example 13 | S | 5 | Abrasion starts from edge |
| Example 14 | S | 5 | Abrasion starts from edge |
| Example 15 | E | 10 | Abrasion starts from edge |
| Example 16 | E | 15 | Abrasion starts from edge |
| Example 17 | E | 15 | Abrasion starts from edge |
| Example 18 | E | 15 | Abrasion starts from edge |
| Example 19 | E | 10 | Abrasion starts from edge |
| Example 20 | E | 10 | Abrasion starts from edge |
| Example 21 | G | 18 | Abrasion starts from edge |
| Example 22 | G | 18 | Abrasion starts from edge |
| Comparative Example 10 | F | 20 | Hollow |
| Comparative Example 11 | F | 20 | Hollow |
| Comparative Example 12 | P | 30 | Hollow |
| Comparative Example 13 | EP | 50 | Chip-off at many places |

Table 4 shows the results of the verification test of Examples 13 to 22 and Comparative Examples 10 to 13.

In Examples 1 to 10, good cleaning performance is maintained over an extended period of time.

The untreated blade of Comparative Example 10 is hollowed by abrasion but no hollow portion but clean abrasion is seen in Examples 13 to 22.

In addition, because the abrasion width is narrow in comparison with the untreated blade, the abrasion resistance is found to be improved.

Among these, Examples 13 to 20 are narrower with regard to the abrasion width and better than Examples 21 and 22.

To the contrary, similar to the untreated blade, hollow portions are observed in Comparative Examples 11 and 12 and the abrasion width thereof is almost the same as the untreated blade.

In addition, in Comparative Example 13, chip-off is observed at a great number of portions of the cleaning blade so that the cleaning property extremely deteriorates.

This document claims priority and contains subject matter related to Japanese Patent Applications no. 2009-276475, 2010-189795, 2010-202251, and 2010-254567, filed on Dec. 4, 2009, Aug. 26, 2010, Sep. 9, 2010 and Nov. 15, 2010, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cleaning blade for use in an image forming apparatus, comprising:

a holder; and an elastic blade attached to the holder and in contact with an image bearing member, the elastic blade being impregnated with an acrylate polymer from at least one surface thereof to a depth of from 5 to 100 μm wherein the at least one surface includes a contact surface in contact with the image bearing member and disposed parallel to a longitudinal direction of the elastic blade, and a first position having a ratio of A/B to A0/B0 of 1.1 is within a depth range of from 5 to 100 μm from the contact surface, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of an other elastic blade which is different from the elastic blade in that no acrylate polymer is applied, and B0 represents a peak area value for 1,597 $cm^{-1}$ obtained by the micro infrared (IR) method according to transmission for the segment of the other elastic blade which is different from the elastic blade in that no acrylate polymer is applied.

2. The cleaning blade according to claim 1, wherein the at least one surface includes a cut surface perpendicular to a longitudinal direction of the elastic blade, and a second position having the ratio of A/B to A0/B0 of 1.1 is within a depth range of from 5 to 100 μm from the cut surface.

3. The cleaning blade according to claim 1, wherein the at least one surface includes a cut surface which is perpendicular to a longitudinal direction of the elastic blade, and wherein a ratio of X/Y is from 0.1 to 10, where X represents a distance between the contact surface and the first position having the ratio of A/B to A0/B0 of 1.1, and Y represents a distance between the cut surface and a second position having the ratio of A/B to A0/B0 of 1.1.

4. The cleaning blade according to claim 1, further comprising a surface layer comprising the acrylate polymer with a thickness of from 0.1 to 3 μm laminated on the elastic blade.

5. The cleaning blade according to claim 1, wherein the elastic blade is manufactured by a process of soaking the elastic blade in a polymerizable acrylate monomer, followed by irradiation of the elastic blade with an energy beam to polymerize the polymerizable acrylate monomer.

6. The cleaning blade according to claim 5, wherein the irradiation of the energy beam is conducted in an environment in which an oxygen density is 2% or less.

7. An image forming apparatus comprising:

an image bearing member that bears a latent electrostatic image on a surface thereof;

a charger that charges the surface of the image bearing member;

an irradiator that irradiates the surface of the image bearing member to form a latent image bearing member thereon;

a development device that develops the latent image bearing member with toner to obtain a toner image;

a transfer device that transfers the toner image to a recording medium; and a cleaning device that removes the toner remaining on the surface of the image bearing member after transfer, a cleaning blade comprising a holder and an elastic blade attached to the holder and in contact with the image bearing member, the elastic blade being impregnated with an acrylate polymer from at least one surface to a depth of from 5 to 100 μm, wherein the at least one surface includes a contact surface in contact with the image bearing member and parallel to a longitudinal direction of the elastic blade, and a first position having a ratio of A/B to A0/B0 of 1.1 is within a depth range of from 5 to 100 μm from the contact surface, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of an other elastic blade which is different from the elastic blade in that no acrylate polymer is applied, and B0 represents a peak area value for 1,597 $cm^{-1}$ obtained by the micro infrared (IR) method according to transmission for the segment of the other elastic blade which is different from the elastic blade in that no acrylate polymer is applied.

8. The image forming apparatus according to claim 7, wherein, in the cleaning blade, the at least one surface includes a cut surface perpendicular to a longitudinal direction of the elastic blade, and a second position having the ratio of A/B to A0/B0 of 1.1 is within a depth range of from 5 to 100 μm from the cut surface.

9. The image forming apparatus according to claim 7, wherein, in the cleaning blade, the at least one surface includes a cut surface perpendicular to a longitudinal direction of the elastic blade, and wherein a ratio of X/Y is from 0.1 to 10, where X represents a distance between the contact surface and the first position having the ratio of A/B to A0/B0 of 1.1, and Y represents a distance between the cut surface and a second position having the ratio of A/B to A0/B0 of 1.1.

10. The image forming apparatus according to claim 7, further comprising a surface layer comprising the acrylate polymer with a thickness of from 0.1 to 3 μm laminated on the elastic blade.

11. The image forming apparatus according to claim 7, wherein the elastic blade is manufactured by a process of soaking the elastic blade in a polymerizable acrylate monomer, followed by irradiation of the elastic blade with an energy beam to polymerize the polymerizable acrylate monomer.

12. The image forming apparatus according to claim 11, wherein the irradiation of the energy beam is conducted in an environment in which an oxygen density is 2% or less.

13. A process cartridge comprising:

an image bearing member that bears a latent electrostatic image on a surface thereof; and a cleaning device that removes the toner remaining on the surface of the image bearing member after transfer, a cleaning blade comprising a holder and an elastic blade attached to the holder and in contact with the image bearing member, the elastic blade being impregnated with an acrylate polymer from at least one surface to a depth of from 5 to 100 μm, wherein the at least one surface includes a contact surface in contact with the image bearing member and parallel to a longitudinal direction of the elastic blade, and a first position having a ratio of A/B to A0/B0 of 1.1 is within a depth range of from 5 to 100 μm from the contact surface, where A represents a peak area value for 1,700 $cm^{-1}$ obtained by a micro infrared (IR) method according to transmission for a segment of the elastic blade, B represents a peak area value for 1,597 $cm^{-1}$ obtained by the micro infrared (IR) method according to transmission for the segment of the elastic blade, A0 represents a peak area value for 1,700 $cm^{-1}$ obtained by the micro infrared (IR) method according to transmission for a segment of an other elastic blade which is different from the elastic blade in that no acrylate polymer is applied, and B0 represents a peak area value for 1,597 $cm^{-1}$ obtained by the micro infrared (IR) method according to transmission for the segment of the other elastic blade which is different from the elastic blade in that no acrylate polymer is applied.

14. The process cartridge according to claim 13, wherein the at least one surface includes a cut surface perpendicular to a longitudinal direction of the elastic blade, and a second position having the ratio of A/B to A0/B0 of 1.1 is within a depth range of from 5 to 100 μm from the cut surface.

15. The process cartridge according to claim 13, wherein the at least one surface includes a cut surface perpendicular to a longitudinal direction of the elastic blade, and wherein a ratio of X/Y is from 0.1 to 10, where X represents a distance between the contact surface and the first position having the ratio of A/B to A0/B0 of 1.1, and Y represents a distance between the cut surface and a second position having the ratio of A/B to A0/B0 of 1.1.

16. The process cartridge according to claim 13, further comprising a surface layer comprising the acrylate polymer with a thickness of from 0.1 to 3 μm laminated on the elastic blade.

17. The process cartridge according to claim 13, wherein the elastic blade is manufactured by a process of soaking the elastic blade in a polymerizable acrylate monomer, followed by irradiation of the elastic blade with an energy beam to polymerize the polymerizable acrylate monomer.

* * * * *